US006132919A

United States Patent [19]

Ogawa et al.

[11] Patent Number: 6,132,919

[45] Date of Patent: Oct. 17, 2000

[54] POLYMERIZED TONER AND PRODUCTION PROCESS THEREOF

[75] Inventors: Tokudai Ogawa; Noboru Yanagida; Takahiro Takasaki; Kazuhiro Sato, all of Kanagawa, Japan

[73] Assignee: Nippon Zeon Co., Ltd., Tokyo, Japan

[21] Appl. No.: 09/305,635

[22] Filed: May 5, 1999

Related U.S. Application Data

[63] Continuation-in-part of application No. PCT/JP97/03972, Oct. 31, 1997.

[30] Foreign Application Priority Data

| | | | |
|---|---|---|---|
| Nov. 6, 1996 | [JP] | Japan | 8-310091 |
| May 22, 1998 | [JP] | Japan | 10-141063 |
| Jun. 9, 1998 | [JP] | Japan | 10-161044 |

[51] Int. Cl.[7] ..... G03G 9/97

[52] U.S. Cl. ..... 430/110; 430/109; 430/137

[58] Field of Search ..... 430/109, 110, 430/137

[56] References Cited

U.S. PATENT DOCUMENTS

| | | | |
|---|---|---|---|
| 4,514,487 | 4/1985 | Kasuya et al. | 430/137 |
| 4,601,968 | 7/1986 | Hyosu | 430/137 |
| 4,626,489 | 12/1986 | Hyosu | 430/137 |
| 5,354,640 | 10/1994 | Kanbayashi et al. | 430/110 |
| 5,407,776 | 4/1995 | Kanbayashi et al. | 430/137 |
| 5,424,162 | 6/1995 | Kohri et al. | 430/110 |
| 5,712,072 | 1/1998 | Inaba et al. | 430/110 |
| 5,952,144 | 9/1999 | Hasegawa et al. | 430/109 |
| 5,958,640 | 9/1999 | Hasegawa et al. | 430/109 |

FOREIGN PATENT DOCUMENTS

| | | |
|---|---|---|
| 0615167 | 9/1994 | European Pat. Off. . |
| 0743564 | 11/1996 | European Pat. Off. . |
| 53-143326 | 12/1978 | Japan . |
| 54-94035 | 7/1979 | Japan . |
| 56-87051 | 7/1981 | Japan . |
| 57-45558 | 3/1982 | Japan . |
| 59-62870 | 4/1984 | Japan . |
| 60-173552 | 9/1985 | Japan . |
| 60-230663 | 11/1985 | Japan . |
| 61-118758 | 6/1986 | Japan . |
| 63-173067 | 7/1988 | Japan . |
| 2-259657 | 10/1990 | Japan . |
| 3-136065 | 6/1991 | Japan . |
| 3-203746 | 9/1991 | Japan . |
| 4-342264 | 11/1992 | Japan . |
| 5-181315 | 7/1993 | Japan . |
| 5-197193 | 8/1993 | Japan . |
| 6-161144 | 6/1994 | Japan . |
| 7-128908 | 5/1995 | Japan . |
| 2097947 | 11/1982 | United Kingdom . |
| 2109572 | 6/1983 | United Kingdom . |

*Primary Examiner*—Roland Martin
*Attorney, Agent, or Firm*—Dinsmore & Shohl LLP

[57] ABSTRACT

A polymerized toner of core-shell structure, comprising core particles composed of colored polymer particles, which comprise a polyfunctional ester compound formed of a trifunctional or still higher polyfunctional polyhydric alcohol and a carboxylic acid, and a colorant, and shell which is formed of a polymer having a glass transition temperature higher than that of a polymer component making up the core particles and covers each of the core particles, a production process thereof, an image forming process comprising using the polymerized toner, and an image forming apparatus containing the polymerized toner.

19 Claims, 1 Drawing Sheet

POLYMERIZED TONER AND PRODUCTION PROCESS THEREOF

This application is a continuation-in-part of pending international application No. PCT/JP97/03972 filed Oct. 31, 1997.

TECHNICAL FIELD

The present invention relates to a polymerized toner and a production process thereof, and more particularly to a polymerized toner suitable for use in developing an electrostatic latent image formed by an electrophotographic process, electrostatic recording process or the like, and a production process thereof. The present invention also relates to an image forming process comprising using such a polymerized toner, and an image forming apparatus containing the polymerized toner.

BACKGROUND ART

In the electrophotographic process or electrostatic recording process, two-component developers composed of a toner and carrier particles, and one-component developers composed substantially of a toner alone and making no use of any carrier particles are known as developers for making electrostatic latent images visible. The one-component developers include magnetic one-component developers containing magnetic powder, and non-magnetic one-component developers containing no magnetic powder. In the non-magnetic one-component developers, a flowability improver such as colloidal silica is often added independently in order to enhance the flowability of the toner. As the toner, there are generally used colored particles obtained by dispersing a colorant such as carbon black and other additives in a binder resin and granulating the dispersion.

Processes for producing a toner are roughly divided into a grinding process and a polymerization process. In the grinding process, a synthetic resin, a colorant and optional other additives are melted and mixed, the mixture is ground, and the ground product is then classified so as to obtain particles having a desired particle diameter, thereby obtaining a toner. In the polymerization process, a polymerizable monomer composition is prepared by uniformly dissolving or dispersing a colorant, a polymerization initiator and optional various additives such as a crosslinking agent and a charge control agent in a polymerizable monomer, the polymerizable monomer composition is dispersed in an aqueous dispersion medium containing a dispersion stabilizer by means of a stirrer to form minute droplets of the polymerizable monomer composition, and the dispersion containing the minute droplets is then heated to subject the droplets to suspension polymerization, thereby obtaining a toner (polymerized toner) having a desired particle diameter.

In either developer, an electrostatic latent image is actually developed with the toner. In an image forming apparatus such as an electrophotographic apparatus or electrostatic recording apparatus, an electrostatic latent image is generally formed on a photosensitive member evenly charged by exposure to a light pattern, and a toner is applied to the electrostatic latent image to form a toner image (make the latent image visible). The toner image is transferred to a transfer medium such bas transfer paper, and the unfixed toner image is then fixed to the transfer medium by a method such as heating, pressing or use of solvent vapor. In the fixing step, the toner is often fusion-bonded to the transfer medium by passing the transfer medium, to which the toner image has been transferred, through between a heating roll (fixing roll) and a press roll to press-bond the toner to the transfer medium under heat.

Images formed by an image forming apparatus such as an electrophotographic copying machine are required to improve their definition year by year. As a toner used in the image forming apparatus, a toner obtained by the grinding process has heretofore been mainly used. The grinding process tends to form colored particles having a wide particle diameter distribution. In order for the toner to exhibit satisfactory developing characteristics, therefore, the ground product must be classified to adjust the particles so as to have a particle diameter distribution limited to a certain extent. However, the classification itself is complicated, and its yield is poor, and so the percent yield of the toner is reduced to a great extent. Therefore, the polymerized toner easy to control its particle diameter without conducting complicated production steps such as classification has come to attract attention in recent years. According to the suspension polymerization process, a polymerized toner having desired particle diameter and particle diameter distribution can be obtained without need of grinding and classification. However, the conventional polymerized toners have involved a problem that they cannot fully meet requirements in recent years, such as the speeding-up of copying, the formation of full-color images and energy saving.

In recent years, copying machines, printers and the like of an electrophotographic system have been required not only to reduce demand power, but also to achieve the speeding-up of copying or printing. A step in which energy is particularly demanded in the electrophotographic system is a fixing step conducted after transferring a toner from a photosensitive member to a transfer medium such as transfer paper. In the fixing step, the toner is fixed to the transfer medium by heating and melting it. Therefore, a heating roll heated to a temperature of at east 150° C. is used, and electric power is used as an energy source therefor. There is a demand for lowering the temperature of the heating roll from the viewpoint of energy saving. In order to lower the temperature of the heating roll, it is necessary to use a toner capable of fixing at a temperature lower than that heretofore used. Namely, it is necessary to lower the fixing temperature of the toner itself. The use of the toner capable of fixing at a temperature lower than that heretofore used permits lowering the temperature of the heating roll, and on the other hand shortening the fixing time when the temperature of the heating roll is not very lowered. Therefore, such a toner can meet the speeding-up of copying and printing.

In order to meet requirements, such as energy saving and the speeding-up of copying, from the image forming apparatus in the design of a toner, it is only necessary to lower the glass transition temperature of a binder resin making up the toner. When a toner is made up of a binder resin having a low glass transition temperature, however, the toner becomes poor in the so-called shelf stability because particles themselves of the toner tend to undergo blocking during storage or shipment, or in a toner box of an image forming apparatus, to aggregate.

In recent years, there has been a demand for formation of bright images in color copying or color printing by the electrophotographic system. For example, in the full-color copying, the mere melting and softening of toners in a fixing step to fusion-bond the toners to a transfer medium are not enough, but it is necessary to uniformly melt and mix the toners of different colors to mix their colors. In particular, since color images have come to be often used in OHP (overhead projector) sheets for presentations in various meetings or conferences, toner images fixed to such OHP sheets have been required to permit the formation of bright or clear images on a screen by permeating the sheets, i.e. have excellent permeability through OHP. In order to meet the excellent permeability through OHP, it is necessary for the toners to uniformly melt on a transparent OHP sheet made of a synthetic resin. Therefore, the melt viscosity of each toner at about the fixing temperature thereof must be designed low compared with the conventional toners. Means for lowering the melt viscosity of the toner include a method in which the molecular weight or glass transition temperature of a binder resin used is lowered compared with the binder resins for the conventional toners. In either method, however, the toner becomes poor in shelf stability because the toner tends to undergo blocking.

As a method for obtaining a polymerized toner having excellent fixing ability, it has heretofore been proposed in, for example, Japanese Patent Application Laid-Open No. 136065/1991 to subject a polymerizable monomer containing a colorant and a charge control agent to suspension polymerization in the presence of a macromonomer. The macromonomer is a relatively long-chain linear molecule having a polymerizable functional group, for example, a group containing an unsaturated bond such as a carbon—carbon double bond, at its molecular chain terminal. According to this method, the macromonomer is incorporated as a monomer unit into the molecular chain of a polymer formed. Therefore, many branches attributable to the long-chain linear molecule of the macromonomer are generated in the molecular chain of the polymer. The polymer apparently becomes a high molecular weight polymer due to entanglement of the branches, i.e., the so-called physical crosslinking, so that the offset resistance of the toner is improved. On the other hand, the physical crosslinking by the macromonomer component is different from chemical crosslinking using a crosslinking monomer such as divinylbenzene and is of a loose crosslinked structure, and so the crosslinked structure is easy to be broken by heating. Accordingly, this polymerized toner is easily melted upon fixing using a heating roll and hence has excellent fixing ability. However, the polymerized toner tends to undergo aggregation among toner particles during storage, and is hence unsatisfactory from the viewpoint of shelf stability.

According to the conventional methods for lowering the fixing temperature of a toner and improving the uniformly melting ability thereof, as described above, an adverse correlation that the fixing ability of the resulting toner is improved, but its shelf stability is lowered arises. As a means for solving this adverse correlation, there has been proposed the so-called capsule type toner in which a toner made up of a binder resin having a low glass transition temperature is covered with a polymer having a high glass transition temperature, thereby improving the blocking resistance of the toner to solve the problem of shelf stability.

As a production process of the capsule type toner, for example, Japanese Patent Application Laid-Open No. 173552/1985 has proposed a process in which a coating layer composed of a colorant, magnetic particles or a conductive agent, and a binder resin is formed on each surface of spherical core particles having a minute particle size by means of a jet mill. As the core particles, there are used particles formed of a thermoplastic transparent resin such as an acrylate resin or styrene resin. In this publication, it has been reported that according to this process, a toner of multi-layer structure, which has excellent flowability and improved functional characteristics, can be obtained. When core particles having a low glass transition temperature are used in this method, however, the core particles themselves tend to undergo aggregation. In addition, according to this method, the coating thickness of the binder resin is liable to thicken. Accordingly, this method is difficult to provide a toner improved in both fixing ability and uniformly melting ability while retaining its good shelf stability.

Japanese Patent Application Laid-Open No. 259657/1990 has proposed a process for producing a toner for electrophotography, in which crosslinked toner particles prepared by suspension polymerization are added to a solution with an encapsulating polymer, a charge control agent and a parting agent dissolved in an organic solvent, and a poor solvent is then added to the resultant mixture to form a coating film of the encapsulating polymer containing the charge control agent and parting agent on each surface of the crosslinked toner particles. According to this process, however, it is difficult to obtain spherical particles because the solubility of the encapsulating polymer is reduced by the addition of the poor solvent to deposit the polymer on each surface of the crosslinked toner particles. The capsule wall formed on the surface of each crosslinked toner particle according to this process is uneven in thickness, and moreover is relatively thick. As a result, the effects of improving development properties and fixing ability become insufficient.

Japanese Patent Application Laid-Open No. 45558/1982 has proposed a process for producing a toner for developing electrostatic latent images, in which core particles formed by polymerization are mixed with and dispersed in a 1 to 40 wt. % aqueous latex solution, and a water-soluble inorganic salt is then added to the dispersion to form a coating layer formed of fine particles obtained by emulsion polymerization on each surface of the core particles. However, this process has involved a drawback that the temperature and humidity dependence of charge properties of the resultant toner becomes great due to the influence of a surfactant and the inorganic salt remaining on the fine particles, and the charge properties are deteriorated under high-temperature and high-humidity conditions in particular.

Japanese Patent Application Laid-Open No. 62870/1984 has proposed a process for producing a toner, in which core particles are formed by suspension polymerization, and a monomer system capable of forming a polymer having a glass transition temperature higher than that of the core particles is caused to be adsorbed on the core particles to polymerize it. However, this process may be often difficult to create a clear core-shell structure.

Japanese Patent Application Laid-Open No. 118758/1986 discloses a process for producing a toner, in which a composition containing a vinyl monomer, a polymerization initiator and a colorant is subjected to suspension polymerization to obtain core particles, and another vinyl monomer capable of providing a polymer having hydrophilicity at least equal to that of the resin contained in the core particles and a glass transition temperature higher than that of said resin is polymerized in the presence of the core particles to form shell on each of the core particles. This publication also discloses that a parting agent such as low molecular weight polyethylene, carnauba wax or silicone oil may be added to the core particles for preventing a part of the toner melted from adhering to the surface of a fixing roll. According to this process, however, the vinyl monomer for forming the shell is caused to be adsorbed on each of the core particles to grow it, so that in many cases, it may be difficult to create a clear core-shell structure because the vinyl monomer absorbed in the interior of the core particles is polymerized. Accordingly, this process is difficult to provide a toner sufficiently improved in shelf stability. In addition, in order to create a clear core-shell structure so as to improve the shelf stability, it has been necessary to thicken the thickness of the shell.

Japanese Patent Application Laid-Open No. 128908/1995 discloses a process for directly producing a polymerized toner by subjecting a monomer composition containing a polymerizable monomer, a colorant and a parting agent to suspension polymerization in an aqueous medium, the process comprising the steps of causing the parting agent to contain in a proportion of 10 to 40 parts by weight per 100 parts by weight of the polymerizable monomer and removing the parting agent on the surface of the toner formed after completion of the polymerization step. According to this process, when a polymer having a polar group is added to the monomer to polymerize the monomer, a core-shell structure is formed because the polar polymer gathers on each surface layer of polymer particles formed. In addition, the parting agent on the surface of the toner is removed, so that staining due to attachment of the parting agent (wax) to a developing drum, a photosensitive drum, a transfer drum and/or the like can be reduced. However, this process cannot fully improve the shelf stability, fixing temperature and the like of the toner and tends to cause fogging, deterioration of image density, etc.

On the other hand, in order to solve an offset phenomenon, there have been proposed methods or process for causing various kinds of parting agents (offset preventing agents) to be contained in a toner. For example, (i) a method comprising using, as an offset preventing agent, a polyolefin having a weight average molecular weight of 1,000 to 45,000, fatty acid metal salt, fatty acid ester, partially saponified fatty acid ester, higher fatty acid, higher alcohol, paraffin wax, polyhydric alcohol ester, fatty acid amide or the like (Japanese Patent Application Laid-Open No. 87051/1981), (ii) a method comprising adjusting a ratio ($d_1/d_2$) of an average diameter ($d_1$) of a parting agent to an average diameter ($d_2$) of a toner to 0.4 to 2.0 (Japanese Patent Application Laid-Open No. 230663/1985), (iii) a process for producing a toner, comprising subjecting a polymerizable monomer to solution polymerization in the presence of an emulsion of a parting agent (Japanese Patent Application Laid-Open No. 181315/1993), (iv) a process for producing a polymerized toner, comprising heating and melting polyolefin wax at a temperature higher than a polymerization temperature to uniformly disperse the melt in a polymerizable monomer and then lowering the temperature to the polymerization temperature to deposit the wax (Japanese Patent Application Laid-Open No. 173067/1988), (v) a process for producing a polymerized toner, comprising mixing a wax solid at room temperature and insoluble in a polymerizable monomer with the polymerizable monomer in a proportion of 1 to 7 parts by weight per 100 parts by weight of the monomer to conduct polymerization, thereby controlling the diameters of toner particles and wax particles taken in the toner particles within respective predetermined ranges (Japanese Patent Application Laid-Open No. 161144/1994), and (iv) a process for producing a polymerized toner, comprising conducting polymerization at a temperature higher than a melting point of a parting agent insoluble in a polymerizable monomer and then forming a layer of a resin having a high softening point outside the resulting polymer particles (Japanese Patent Application Laid-Open No. 197193/1993) have been proposed. However, these conventional methods or processes can not fully meet offset resistance, fixing ability or shelf stability or are difficult to apply to the production of a polymerized toner by the suspension polymerization process, so that fully satisfactory results cannot be obtained.

DISCLOSURE OF THE INVENTION

It is an object of the present invention to provide a polymerized toner which has a low fixing temperature and uniformly melting ability, and is excellent in shelf stability (blocking resistance) and hard to cause fogging, deterioration of image density, etc., and a production process thereof.

Another object of the present invention is to provide a polymerized toner which can meet the speeding-up of copying or printing, the formation of full-color images, and energy saving, and a production process thereof.

A further object of the present invention is to provide a polymerized toner capable of forming a toner image which exhibits excellent permeability (permeability through OHP) when conducting printing on an OHP sheet with the toner and fixing the resulting image thereto, and a production process thereof.

A still further object of the present invention is to provide a polymerized toner which has excellent offset resistance, shelf stability and flowability, can meet the high-speed printing at a low fixing temperature, can achieve high resolution and is suitable for use as a color toner, and a production process thereof.

A yet still further object of the present invention is to provide an image forming process comprising using the polymerized toner having such excellent various properties, and an image forming apparatus in which said polymerized toner is contained.

The present inventors have carried out an extensive investigation with a view toward overcoming the above-described problems involved in the prior art. As a result, the inventors have conceived of a polymerized toner of core-shell structure, in which each of core particles composed of colored polymer particles, which comprise a polyfunctional ester compound formed of a trifunctional or still higher polyfunctional polyhydric alcohol and a carboxylic acid, and a colorant, is covered with shell formed of a polymer having a glass transition temperature higher than that of a polymer component making up the core particles.

This polymerized toner can be suitably produced by subjecting a composition containing the polyfunctional ester compound, the colorant and a polymerizable monomer capable of forming a polymer having a glass transition temperature of 80° C. or lower to suspension polymerization, preferably, in the presence of a macromonomer to prepare colored polymer particles, and then using the colored polymer particles as core particles to subject another polymerizable monomer capable of forming a polymer having a glass transition temperature higher than that of the polymer component making up the core particles to suspension polymerization in the presence of the core particles, thereby forming shell which is formed of a polymer layer and covers each of the core particles.

According to the polymerized toner of the present invention, the core particles containing the polyfunctional ester compound and the polymer component having a lower glass transition temperature permit lowering the fixing temperature of the toner, also improving the uniformly melting ability, meeting requirements such as the speeding-up of copying or printing, the formation of full-color images and good permeability through OHP, and further forming a high-quality image because they make it hard to cause fogging, deterioration of image density and the like. On one hand, according to the polymerized toner of the present invention, each of the core particles can be covered with the thin shell, so that the toner can exhibit good shelf stability (blocking resistance) and moreover fully meet various requirements such as fixing ability and uniformly melting ability.

The polyfunctional ester compound is generally easily soluble in a polymerizable monomer. The polyfunctional ester compound fulfills a function as a parting agent (offset preventing agent). Therefore, when the polyfunctional ester compound is referred to as a parting agent (a), the parting agent (a) can be used in combination with another parting agent. In particular, when it is used in combination with a parting agent (b) prepared by finely dispersing a hydrophobic material hardly soluble in a polymerizable monomer in water and then drying the resultant dispersion, a polymerized toner, which has excellent offset resistance, shelf stability, flowability and fixing ability at low temperatures, has low dependence of the image quality of images formed thereby on environment and can provide prints of high image quality, can be obtained. When the parting agent (a) is used in combination with the parting agent (b), it is preferred that the suspension polymerization temperature be preset to a temperature not higher than the endothermic peak temperature of the parting agent (a).

The present invention has been led to completion on the basis of these findings.

According to the present invention, there is thus provided a polymerized toner of core-shell structure, comprising core particles composed of colored polymer particles, which comprise a polyfunctional ester compound formed of a trifunctional or still higher polyfunctional polyhydric alcohol and a carboxylic acid, and a colorant, and shell which is formed of a polymer having a glass transition temperature higher than that of a polymer component making up the core particles and covers each of the core particles.

According to the present invention, there is also provided a process for producing a polymerized toner of core-shell structure, which comprises the steps of (1) subjecting a polymerizable monomer composition containing a polyfunctional ester compound formed of a trifunctional or still higher polyfunctional polyhydric alcohol and a carboxylic acid, a colorant, and a polymerizable monomer for core, which is capable of forming a polymer having a glass transition temperature of 80° C. or lower, to suspension polymerization in an aqueous dispersion medium containing a dispersing agent to prepare core particles formed of colored polymer particles; and then (2) subjecting a polymerizable monomer for shell, which is capable of forming a polymer having a glass transition temperature higher than that of a polymer component making up the core particles, to suspension polymerization in the presence of the core particles, thereby forming shell which is formed of a polymer layer and covers each of the core particles.

According to the present invention, there is further provided an image forming process, comprising the steps of applying a toner to the surface of a photosensitive member, on which an electrostatic latent image has been formed, to make the latent image visible, and then transferring the visible image to a transfer medium, wherein the above-described polymerized toner of core-shell structure is used as the toner.

According to the present invention, there is still further provided an image forming apparatus, comprising a photosensitive member, a means for charging the surface of the photosensitive member, a means for forming an electrostatic latent image on the surface of the photosensitive member, a means for receiving a toner, a means for supplying the toner to develop the electrostatic latent image on the surface of the photosensitive member, thereby forming a toner image, and a means for transferring the toner image from the surface of the photosensitive member to a transfer medium, wherein the means for receiving the toner contains the above-described polymerized toner of core-shell structure.

BEST MODE FOR CARRYING OUT THE INVENTION

Figure 1:
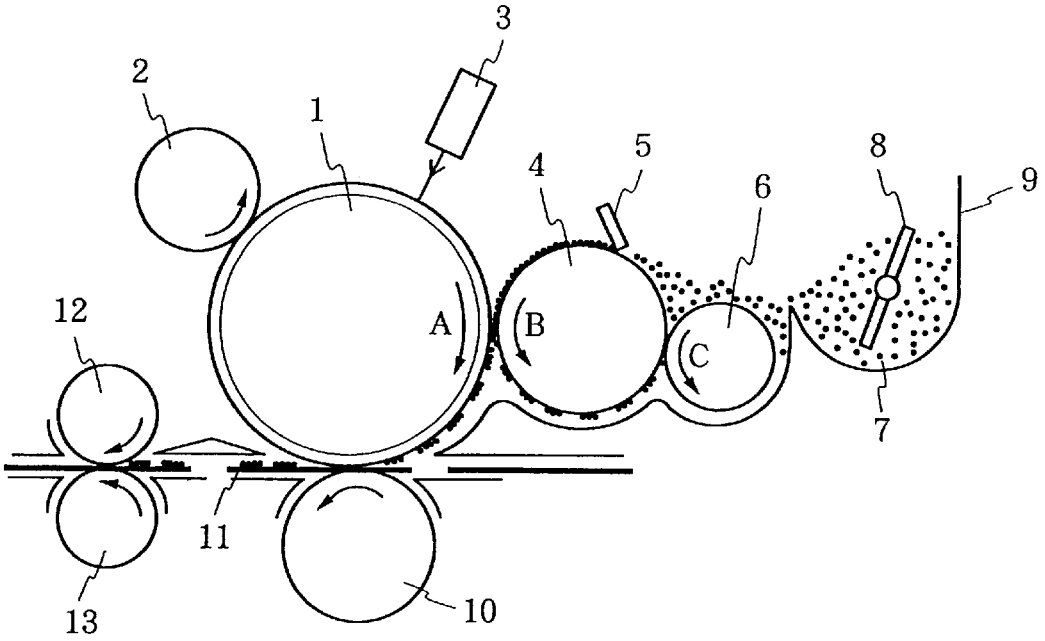
FIG. 1 is a cross-sectional view illustrating an example of an image forming apparatus to which a polymerized toner according to the present invention is applied.

The polymerized toner according to the present invention is a polymerized toner of a core-shell structure, comprising core particles and shell which covers each of the core particles. The polymerized toner according to the present invention can be produced by polymerizing a polymerizable monomer for shell in the presence of core particles. The core particles comprise, as essential components, a polyfunctional ester compound formed of a trifunctional or still higher polyfunctional polyhydric alcohol and a carboxylic acid, and a colorant in a polymer component (binder resin). The glass transition temperature of a polymer component making up the shell is higher than that of the polymer component making up the core particles.

Polyfunctional Ester Compound

The polyfunctional ester compound useful in the practice of the present invention is an ester formed of a trifunctional or still higher polyfunctional polyhydric alcohol and a carboxylic acid.

Examples of the trifunctional or still higher polyfunctional polyhydric alcohol include aliphatic alcohols such as glycerol, pentaerythritol and pentaglycerol; alicyclic alcohols such as phloroglucitol, quercitol and inositol; aromatic alcohols such as tris-(hydroxymethyl)benzene; saccharides such as D-erythrose, L-arabinose, D-mannose, D-galactose, D-fructose, L-rhamnose, saccharose, maltose and lactose; and sugar alcohols such as erythoritol, D-threitol, L-arabitol, adonitol and xylitol. Of these, pentaerythritol is preferred.

Examples of the carboxylic acid include aliphatic carboxylic acids such as acetic acid, butyric acid, caproic acid, enanthic acid, caprylic acid, pelargonic acid, capric acid, undecanoic acid, lauric acid, myristic acid, stearic acid, margaric acid, arachidic acid, cerotic acid, melissic acid, erucic acid, brassidic acid, sorbic acid, linolic acid, linolenic acid, behenolic acid, tetrolic acid and ximenynic acid; alicyclic carboxylic acids such as cyclohexanecarboxylic acid, hexahydroisophthalic acid, hexahydroterephthalic acid and 3,4,5,6-tetrahydrophthalic acid; and aromatic carboxylic acids such as benzoic acid, toluic acid, cuminic acid, phthalic acid, isophthalic acid, terephthalic acid, trimesic acid, trimellitic acid and hemimellitic acid. Of these, carboxylic acids having, preferably, 10 to 30 carbon atoms, more preferably, 13 to 25 carbon atoms are preferred, and aliphatic carboxylic acids having the said number of carbon atoms are more preferred. Among the aliphatic carboxylic acids, stearic acid and myristic acid are particularly preferred.

In the polyfunctional ester compound used in the present invention, the carboxylic acids reacting with at least 3 functional groups (OH groups) of the polyhydric alcohol to form respective ester bonds may be the same or different from one another. When the kinds of the carboxylic acids reacting with the polyhydric alcohol are different from one another, it is desirable that a difference between the maximum value and the minimum value in the number of carbon atoms among the carboxylic acids be preferably at most 9, more preferably at most 5.

The polyfunctional ester compound is preferably a compound represented by the formula (I):

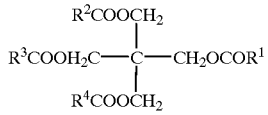

(I)

wherein $R^1$, $R^2$, $R^3$ and $R^4$ are independently an alkyl group or phenyl group, and the number of carbon atoms of the alkyl group or phenyl group is preferably 10 to 30, more preferably 13 to 25.

As specific examples of the polyfunctional ester compound, may be mentioned pentaerythritol tetrastearate [a compound in which $R^1$, $R^2$, $R^3$ and $R^4$ in the formula (I) are all $CH_3(CH_2)_{16}$ groups], pentaerythritol tetramyristate [a compound in which $R^1$, $R^2$, $R^3$ and $R^4$ in the formula (I) are all $CH_3(CH_2)_{12}$ groups], pentaerythritol tetrapalmitate [a compound in which $R^1$, $R^2$, $R^3$ and $R^4$ in the formula (I) are all $CH_3(CH_2)_{14}$ groups], pentaerythritol tetralaurate [a compound in which $R^1$, $R_2$, $R^3$ and $R^4$ in the formula (I) are all $CH_3(CH_2)_{10}$ groups], dipentaerythritol hexalaurate, and glycerol triarachidate. The polyfunctional ester compound is preferably easily soluble in a polymerizable monomer for core.

The polyfunctional ester compound is used in a proportion of generally 0.1 to 40 parts by weight, preferably 1 to 30 parts by weight, more preferably 3 to 25 parts by weight per 100 parts by weight of a polymer component making up core particles or a monomer for forming the polymer component (polymerizable monomer for core). The proportion of the polyfunctional ester compound used falls within the above range, whereby a polymerized toner, which has a low fixing temperature and uniformly melting ability, and is excellent in shelf stability (blocking resistance) and hard to cause fogging, deterioration of image density, etc., can be provided. If the proportion of the polyfunctional ester compound used is too low, its effect becomes little. If the proportion is too high on the other hand, it is difficult to form the core particles, and the shelf stability of the resulting polymerized toner is also deteriorated.

Since the polyfunctional ester, which is a condensate of a trifunctional or still higher polyfunctional alcohol and a carboxylic acid, fulfills a function as a parting agent, it may be referred to as "parting agent (a)" in the specification. The parting agent (a) is generally easily soluble in a polymerizable monomer for core. The parting agent (a) is dissolved in a proportion of generally at least 3 g, preferably at least 5 g, more preferably at least 10 g in 100 g of the polymerizable monomer for core at 25° C.

Colorant

As examples of the colorant useful in the practice of the present invention, may be mentioned dyes and pigment such as carbon black, titanium white, Nigrosine Base, aniline blue, Chalcoil Blue, chrome yellow, ultramarine blue, Orient Oil Red, Phthalocyanine Blue and Malachite Green oxalate; and magnetic powders such as cobalt, nickel, diiron trioxide, triiron tetroxide, manganese iron oxide, zinc iron oxide and nickel iron oxide.

Examples of colorants for magnetic color toners include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. Examples of pigments for magnetic color toners include chrome yellow, cadmium yellow, Mineral Fast Yellow, Navel Yellow, Naphthol Yellow S, Hansa Yellow G, Permanent Yellow NCG, Tartrazine Lake, chrome orange, molybdenum orange, Permanent Orange GTR, Pyrazolone Orange, Benzidine Orange, cadmium red, Permanent Red 4R, Watchung Red Ca, eosine lake, Brilliant Carmine 3B, manganese violet, Fast Violet B, Methyl Violet Lake, iron blue, cobalt blue, Alkali Blue Lake, Victoria Blue Lake, Phthalocyanine Blue, Fast Sky Blue, Indanthrene Blue BC, chrome green, chromium oxide, Pigment Green B, Malachite Green Lake and Final Yellow Green G.

Examples of magenta color pigments for full-color toners include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. Pigment Violet 19; and C.I. Vat Red 1, 2, 10, 13, 15, 23, 29 and 35.

Examples of magenta dyes for full-color toners include oil-soluble dyes such as C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28.

Examples of cyan color pigments for full-color toners include C.I. Pigment Blue 2, 3, 15, 16 and 17; C.I. Vat Blue 6; C.I. Acid Blue 45; and copper phthalocyanine dyes with 1 to 5 phthalimidomethyl groups added to a phthalocyanine skeleton.

Examples of yellow color pigments for full-color toners include C.I. Pigment Yellow 1, 2, 3, 4, 5, 6, 7, 10, 11, 12, 13, 14, 15, 16, 17, 23, 65, 73, 83 and 138; and C.I. Vat Yellow 1, 3 and 20.

These dyes or pigments are used in a proportion of generally 0.1 to 20 parts by weight, preferably 1 to 10 parts by weight per 100 parts by weight of the polymer component making up the core particles or the polymerizable monomer for core. The magnetic powder is used in a proportion of generally 1 to 100 parts by weight, preferably 5 to 50 parts by weight per 100 parts by weight of the polymer component making up the core particles or the polymerizable monomer for core.

Core Particles

The core particles useful in the practice of the present invention comprise, as a polymer component (binder resin), a (co)polymer of a vinyl monomer, such as a polyester resin, or a (meth)acrylic ester-styrene copolymer. As the polymer component for the core particles, the (meth)acrylic ester-styrene copolymer is preferred because it is easy to form particles by polymerization and control the glass transition temperature of the polymer component.

In the polymerized toner according to the present invention, the volume average particle diameter (dv) of the core particles is generally 0.5 to 20 μm, preferably 1 to 10 μm, more preferably 3 to 8 μm. If the core particles are too great, the resolution of an image formed with such a toner tends to lower. The ratio (dv)/(dp) of the volume average particle diameter (dv) to a number average particle diameter (dp) in the core particles is generally at most 1.7, preferably at most 1.5, more preferably at most 1.3. If this ratio is too high, the resolution of an image formed with such a toner tends to lower.

No particular limitation is imposed on the production process of the core particles used in the present invention, and any of emulsion polymerization, suspension polymerization, precipitation polymerization and soap-free polymerization may be used. However, a process comprising subjecting a polymerizable monomer for core to suspension polymerization is preferred in that the polyfunctional ester compound and colorant can be uniformly contained in each of core particles formed, and the fixing ability of the resulting toner is improved.

The polymerizable monomer for core used in the present invention is such that can form a polymer having a glass transition temperature of generally 80° C. or lower, preferably 10 to 70° C., more preferably 15 to 60° C. As the polymerizable monomer for core, there may be used one of such monomers or any combination of such monomers. If the glass transition temperature of a polymer formed of the polymerizable monomer for core is too high, the resulting polymerized toner comes to have a higher fixing temperature and deteriorated permeability through OHP and can not meet the speeding-up of copying or printing.

The glass transition temperature (Tg) of the polymer is a calculated value (referred to as calculated Tg) calculated out according to the kind(s) and proportion(s) of monomer(s) used. When the monomer used is one, the Tg of a homopolymer formed from this monomer is defined as Tg of the polymer in the present invention. For example, the Tg of polystyrene is 100° C. Therefore, when styrene is used as a monomer by itself, the monomer can be said to form a polymer having a Tg of 100° C. When monomers used are two or more, and the polymer formed is a copolymer, the Tg of the copolymer is calculated out according to the kinds and proportions of the monomers used. For example, when 78 wt. % of styrene and 22 wt. % of n-butyl acrylate are used as monomers, the monomers can be said to form a polymer having a Tg of 50° C. because the Tg of a styrene-n-butyl acrylate copolymer formed at this monomer ratio is 50° C.

The glass transition temperature (Tg) of the polymer is calculated out in accordance with the following equation:

$$1/Tg=W_1/T_1+W_2/T_2+W_3/T_3+\ldots W_n/T_n$$

wherein

Tg: glass transition temperature (absolute temperature) of a copolymer;

$W_1$, $W_2$, $W_3$ . . . $W_n$: weight percent of a specified monomer in the copolymer; and $T_1$, $T_2$, $T_3$ . . . $T_n$: glass transition temperature (absolute temperature) of a homopolymer composed of the specified monomer.

The definition of "a polymerizable monomer for core, which is capable of forming a polymer having a glass transition temperature of 80° C. or lower" does not mean that when plural monomers are used, the individual monomers must form respective polymers having a Tg of 80° C. or lower. When one monomer is used, the Tg of a homopolymer formed from the monomer must be 80° C. or lower. When two or more monomers are used, however, it is only necessary for the Tg of a copolymer formed from the monomer mixture to be 80° C. or lower. Therefore, those which separately form a homopolymer having a Tg higher than 80° C. may be contained in the monomer mixture. For example, although the Tg of a styrene homopolymer is 100° C., styrene may be used as a component of the polymerizable monomer for core so far as a copolymer having a Tg of 80° C. or lower can be formed by using a mixture of styrene with a monomer (for example, n-butyl acrylate) which forms a homopolymer having a low Tg.

In the present invention, vinyl monomers are generally used as the polymerizable monomer for core. Various kinds of vinyl monomers are used either singly or in combination of two or more thereof so as to adjust the Tg of the resulting polymer within the desired range.

Examples of the vinyl monomers used in the present invention include styrenic monomers such as styrene, vinyltoluene and α-methylstyrene; acrylic acid and methacrylic acid; (meth)acrylic acid derivatives such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These vinyl monomers may be used either singly or in any combination thereof. Of these, the styrenic monomers, or the (meth)acrylic acid derivatives are preferably used as a polymerizable monomer for core.

Of these, a combination of a styrenic monomer with a (meth)acrylic acid derivative is preferably used as the polymerizable monomer for core. As particularly preferable specific examples thereof, may be mentioned combinations of styrene with butyl acrylate (i.e., n-butyl acrylate), and styrene with 2-ethylhexyl acrylate.

It is preferred from the viewpoint of improvement in the shelf stability and offset resistance of the resulting polymerized toner to use a crosslinking monomer in combination with the polymerizable monomer for core composed of the vinyl monomer(s). Examples of the crosslinking monomer include aromatic divinyl compounds such as divinylbenzene, divinylnaphthalene and derivatives thereof; diethylenic esters of unsaturated carboxylic acids such as ethylene glycol dimethacrylate and diethylene glycol dimethacrylate; divinyl compounds such as N,N-divinylaniline and divinyl ether; and compounds having at least three vinyl groups.

These crosslinking monomers may be used either singly or in any combination thereof. It is desirable that the crosslinking monomer be used in a proportion of generally 0.1 to 5 parts by weight, preferably 0.3 to 2 parts by weight per 100 parts by weight of the polymerizable monomer for core.

In the present invention, a macromonomer is preferably copolymerized with the polymerizable monomer for core from the viewpoint of improving the balance between the shelf stability and fixing ability of the resulting polymerized toner. In order to copolymerize the macromonomer, it is only necessary to polymerize a polymerizable monomer composition containing the polyfunctional ester compound, the colorant and the polymerizable monomer for core in the presence of the macromonomer to synthesize colored polymer particles (core particles). In fact, it is preferred that the macromonomer be contained in the polymerizable monomer composition to conduct suspension polymerization.

The macromonomer (also referred to as macromer) is a relatively long-chain linear molecule having a polymerizable functional group (for example, a group containing an unsaturated bond such as a carbon—carbon double bond) at its molecular chain terminal. The macromonomer is preferably an oligomer or polymer having a polymerizable vinyl functional group at its molecular chain terminal and a number average molecular weight of generally 1,000 to 30,000. If a macromonomer having a too low number average molecular weight is used, the surface part of the resulting polymerized toner becomes soft, and its shelf stability shows a tendency to deteriorate. If a macromonomer having a too high number average molecular weight is used on the other hand, resulting in a polymerized toner deteriorated in fixing ability and shelf stability.

Examples of the polymerizable vinyl functional group which the macromonomer has at its molecular chain terminal include an acryloyl group and a methacryloyl group, with the methacryloyl group being preferred from the viewpoint of easy copolymerization.

The macromonomer used in the present invention preferably has a glass transition temperature higher than that of a polymer obtained by polymerizing the polymerizable monomer for core. A difference in Tg between the polymer obtained by polymerizing the polymerizable monomer for core and the macromonomer may be relative. For example, when the polymerizable monomer for core is such that forms a polymer having a Tg of 80° C., it is only necessary for the macromonomer to have a Tg higher than 80° C. When the polymerizable monomer for core is such that forms a polymer having a Tg of 50° C., the macromonomer may also be that having a Tg of, for example, 60° C. The Tg of the macromonomer is a value measured by means of an ordinary measuring device such as a DSC.

As specific examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7.

Of these macromonomers, hydrophilic macromonomers, in particular, polymers obtained by polymerizing methacrylic esters or acrylic esters either singly or in combination of two or more monomers thereof are preferred in the present invention.

The amount of the macromonomer used is generally 0.01 to 10 parts by weight, preferably 0.03 to 5 parts by weight, more preferably 0.05 to 1 part by weight per 100 parts by weight of the polymerizable monomer for core. If the amount of the macromonomer used is too little, the shelf stability of the resulting polymerized toner is deteriorated. If the amount of the macromonomer used is too great, the fixing ability of the resulting polymerized toner is deteriorated.

In the present invention, it is preferred that the core particles be provided by subjecting the polymerizable monomer for core, the macromonomer and optionally the crosslinking monomer to suspension polymerization.

The suspension polymerization is generally performed in an aqueous dispersion medium containing a dispersing agent. More specifically, the suspension polymerization is conducted by mixing a polymerizable monomer (vinyl monomer) for core, a polyfunctional ester compound, a colorant, a macromonomer, an optional crosslinking monomer, a radical polymerization initiator and other additives, uniformly dispersing them by means of a ball mill or the like to prepare a liquid mixture (polymerizable monomer composition), pouring the liquid mixture into an aqueous dispersion medium containing a dispersing agent, dispersing the liquid mixture in the dispersion medium by means of a mixer having high shearing force to form minute droplets, and then subjecting them to suspension polymerization at a temperature of generally 30 to 200° C., preferably 35 to 95° C.

It is preferred that the individual component other than the polymerization initiator be mixed in an aqueous dispersion medium to form primary droplets, the polymerization initiator be then added to the aqueous dispersion medium, and the resultant mixture be further mixed to form secondary droplets so as to become smaller to the size of toner. No particular limitation is imposed on the method for forming droplets of the polymerizable monomer composition for core in the aqueous dispersion medium. However, an example thereof includes a method of stirring and mixing the composition by means of any of various kinds of mixers capable of mixing with high shearing force. Particularly preferred is a method of passing the monomer composition through a space between a rotor rotating at a high speed and stator surrounding the rotor and having small holes or comb-like teeth.

In the forming step of the droplets, the droplets of the polymerizable monomer for core are formed in such a manner that the size of the droplets in the aqueous dispersion medium is generally about 0.5 to 20 $\mu$m, preferably about 1 to 10 $\mu$m, more preferably about 3 to 8 $\mu$m in terms of the volume average particle size thereof. A ratio of the volume average particle diameter to the number average particle diameter of the droplets is generally 1 to 3.0, preferably 1 to 2.0. If the particle diameter distribution of the droplets is too wide, the particle diameter distribution of the resulting polymerized toner becomes wide, so that disadvantages such as transfer failure, fogging and filming come to be caused. The droplets preferably have a particle diameter distribution that at least 30 vol. %, preferably at least 50 vol. % of the droplets fall within a range of the volume average particle size ±1 $\mu$m.

A dispersing agent preferably used in the present invention is colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Of these, colloids of hardly water-soluble metal hydroxides are preferred because the particle diameter distribution of the resulting polymer particles can be narrowed, and the brightness or sharpness of an image formed from such a polymerized toner is enhanced.

The colloid of the hardly water-soluble metal hydroxide is not limited by the production process thereof. However, colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase is preferred. This colloid is used as an aqueous dispersion.

The colloid of the hardly water-soluble metal hydroxide used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the suspension polymerization is broken, and the shelf stability of the resulting polymerized toner is deteriorated.

The dispersing agent is generally used in a proportion of 0.1 to 20 parts by weight per 100 parts by weight of the monomer for core. If the amount of the dispersing agent used is too little, it is difficult to achieve sufficient polymerization stability, so that the resulting polymer tends to aggregate. If the amount of the dispersing agent used is too great on the other hand, the effect of the dispersing agent on polymerization stability is saturated, which is uneconomical. In addition, the viscosity of the aqueous dispersion medium becomes too high, resulting in difficulty of forming fine droplets of the liquid mixture.

In the present invention, a water-soluble polymer may be used as a dispersing agent as needed. As examples of the water-soluble polymer, may be mentioned polyvinyl alcohol, methyl cellulose and gelatin. In the present invention, there is no need to use any surfactant. However, a surfactant may be used for the purpose of stably conducting the suspension polymerization so far as the dependence of the charge properties of the resulting polymerized toner on environment does not become large.

As examples of the radical polymerization initiator, may be mentioned water-soluble polymerization initiators, such as persulfates such as potassium persulfate and ammonium persulfate; and azo compounds such as 4,4-azobis(4-cyanovaleric acid), 2,2-azobis(2-amidinopropane) bihydrochloride, 2,2-azobis-2-methyl-N-1,1-bis-(hydroxymethyl)-2-hydroxyethylpropionamide, 2,2'-azobis (2,4-dimethylvaleronitrile), 2,2'-azobisisobutyronitrile and 1,1'-azobis(1-cyclohexanecarbonitrile); and oil-soluble polymerization initiators, such as peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be mentioned.

Of these radical polymerization initiators, the oil-soluble radical initiators are preferred, with oil-soluble radical initiators selected from among organic peroxides whose ten-hour half-life temperatures are 60 to 80° C., preferably 65 to 80° C. and whose molecular weights are 250 or lower being particularly preferred. Of the oil-soluble radical initiators, t-butyl peroxy-2-ethyl-hexanoate and t-butyl peroxyneodecanoate are particularly preferred because the resulting polymerized toner scarcely gives odor upon printing and barely causes environmental destruction by volatile components such as odor.

The amount of the polymerization initiator used is generally 0.001 to 3 wt. % based on the aqueous medium. If the amount of the polymerization initiator used is less than 0.001 wt. %, the rate of polymerization becomes slow. If the amount exceeds 3 wt. %, particles having a particle diameter smaller than 1 $\mu$m are formed as a by-product. It is hence not preferable to use the initiator in such a little or great amount.

In the present invention, as needed, various kinds of additives such as a molecular weight modifier may be used by mixing them with the polymerizable monomer for core.

Examples of the molecular weight modifier include mercaptans such as t-dodecylmercaptan, n-dodecylmercaptan and n-octylmercaptan; and halogenated hydrocarbons such as carbon tetrachloride and carbon tetrabromide. The molecular weight modifier may be added before the initiation of the polymerization or in the course of the polymerization. The molecular weight modifier is used in a proportion of generally 0.01 to 10 parts by weight, preferably 0.1 to 5 parts by weight per 100 part by weight of the polymerizable monomer for core.

As the charge control agent, there may be used various kinds of charge control agents for positive charge and negative charge. As specific examples of the charge control agents, may be mentioned Bontron NO1 (Nigrosine, product of Orient Chemical Industries Ltd.), Bontron EX (Nigrosine, product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.) and Bontron E-84 (product of Orient Chemical Industries Ltd.). The charge control agent is used in a proportion of generally 0.01 to 10 parts by weight, preferably 0.1 to 5 parts by weight per 100 parts by weight of the polymerizable monomer for core.

In the polymerized toner according to the present invention, the polyfunctional ester compound also fulfills a function as a parting agent, and so it is not always necessary to use any other parting agent. However, a parting agent, for example, a low molecular weight polyolefin such as low molecular weight polyethylene, low molecular weight polypropylene or low molecular weight polybutylene; or a paraffin wax, may be used within limits not impeding the objects of the present invention.

A lubricant such as oleic acid or stearic acid; a dispersion aid such as a silane or titanium coupling agent; and/or the like may also be used with a view toward uniformly dispersing the colorant in the core particles. Such a lubricant or dispersion aid is generally used in a proportion of about 1/1,000 to 1/1 based on the weight of the colorant.

The polymerization for obtaining the core particles is continued until the conversion of the polymerizable monomer into a polymer reaches generally at least 80%, preferably at least 85%, more preferably at least 90%. If the conversion into the polymer is lower than 80%, a great amount of the polymerizable monomer for core remains unreacted, so that each surface of the resultant core particles is covered with a copolymer of the polymerizable monomer for core and a polymerizable monomer for shell even when the polymerizable monomer for shell is added to conduct polymerization. Therefore, a difference in Tg between the core particles and the shell becomes small, and so the shelf stability of the resulting polymerized toner tends to lower.

Shell

In the present invention, the polymerized toner can be obtained by polymerizing a polymerizable monomer for shell in the presence of the core particles.

The polymerizable monomer for shell used in the present invention is such that can form a polymer having a glass transition temperature higher than that of the polymer component making up the core particles. A difference in Tg between the polymer obtained by the polymerizable monomer for shell and the polymer component making up the core particles is relative.

As the polymerizable monomer for shell, there may be used monomers capable of forming a polymer having a glass transition temperature higher than 80° C., for example, styrene and methyl methacrylate, either singly or in combination of two or more monomers thereof. When the glass transition temperature of the polymer component of the core particles is far lower than 80° C., the polymerizable monomer for shell may be such that forms a polymer having a glass transition temperature of 80° C. or lower. However, the glass transition temperature of the polymer formed from the polymerizable monomer for shell must be preset so as to be higher than the glass transition temperature of the polymer component of the core particles. In order to improve the shelf stability of the resulting polymerized toner, the glass transition temperature of the polymer formed from the polymerizable monomer for shell is preset within a range of generally 50 to 120° C., preferably 60 to 115° C., more preferably 80 to 110° C. If the glass transition temperature of the polymer formed from the polymerizable monomer for shell is too low, the shelf stability of the resulting polymerized toner may be lowered in some cases even if such a glass transition temperature is higher than that of the polymer component of the core particles. In many cases, the glass transition temperature of the polymer component of the core particles may be represented by the calculated Tg of a polymer formed from the polymerizable monomer for core.

A difference in glass transition temperature between the polymer formed from the polymerizable monomer for core and the polymer formed from the polymerizable monomer for shell is generally at least 10° C., preferably at least 20° C., more preferably at least 30° C.

The polymerizable monomer for shell is preferably polymerized in the presence of the core particles after it is formed into droplets smaller than the number average particle diameter of the core particles in an aqueous dispersion medium. If the droplet diameter of the droplets of the polymerizable monomer for shell is too great, the shelf stability of the resulting polymerized toner shows a tendency to lower.

In order to form the polymerizable monomer for shell into fine droplets, a mixture of the polymerizable monomer for shell and the aqueous dispersion medium is subjected to a finely dispersing treatment by means of, for example, an ultrasonic emulsifier. It is preferred that the aqueous dispersion thus obtained be added to the reaction system in which the core particles are present.

The polymerizable monomer for shell is not particularly limited by solubility in water at 20° C. However, a polymerizable monomer for shell having a high solubility in water, specifically, a monomer having a solubility of at least 0.1 wt. % in water at 20° C. becomes liable to quickly migrate to the surfaces of the core particles, so that a polymerized toner having good shelf stability is easy to obtain.

On the other hand, when a polymerizable monomer for shell having a solubility lower than 0.1 wt. % in water at 20° C. is used, its migration to the surfaces of the core particles becomes slow. Therefore, it is preferable to polymerize such a monomer after adding it in the form of fine droplets to the reaction system. Even when a polymerizable monomer for shell having a solubility lower than 0.1 wt. % in water at 20° C. is used, the polymerizable monomer for shell becomes easy to quickly migrate to the surfaces of the core particles when an organic solvent having a solubility of at least 5 wt. % in water at 20° C. is added to the reaction system, so that a polymerized toner having good shelf stability is easy to obtain.

Examples of the polymerizable monomer for shell having a solubility lower than 0.1 wt. % in water at 20° C. include styrene, butyl acrylate, 2-ethylhexyl acrylate, ethylene and propylene. Examples of the polymerizable monomer for shell having a solubility of at least 0.1 wt. % in water at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

As examples of an organic solvent preferably used in the case where the polymerizable monomer for shell having a solubility lower than 0.1 wt. % in water at 20° C. is used, may be mentioned lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and amides such as dimethylformamide.

The organic solvent is added in such an amount that the solubility of the polymerizable monomer for shell in the dispersion medium (containing water and the organic solvent in combination) is at least 0.1 wt. %. The specific amount of the organic solvent added varies according to the kind of the organic solvent, and the kind and amount of the polymerizable monomer for shell. However, it is generally 0.1 to 50 parts by weight, preferably 0.1 to 40 parts by weight, more preferably 0.1 to 30 parts by weight per 100 parts by weight of the aqueous dispersion medium. No particular limitation is imposed on the order of addition of the organic solvent and the polymerizable monomer for shell to the reaction system. In order to facilitate the migration of the polymerizable monomer for shell to the core particles to make easy to obtain a polymerized toner having good shelf stability, however, it is preferable to first add the organic solvent to the reaction system and then add the polymerizable monomer for shell.

When a monomer having a solubility lower than 0.1 wt. % in water at 20° C. and a monomer having a solubility of at least 0.1 wt. % in water at 20° C. are used in combination, it is preferable to first add the monomer having a solubility of at least 0.1 wt. % in water at 20° C. to polymerize it, then add the organic solvent, and further add the monomer having a solubility lower than 0.1 wt. % in water at 20° C. to polymerize it. According to this adding process, the Tg of the polymer obtained from the polymerizable monomer for shell, which is polymerized in the presence of the core particles for the purpose of controlling the fixing temperature of the resulting polymerized toner, and the amount of the monomer added can be suitably controlled.

The polymerizable monomer for shell is preferably used in combination with a charge control agent. The incorporation of the charge control agent into the shell permits improving the charge properties of the resulting polymerized toner. As the charge control agent, there may be used such various kinds of charge control agents for positive charge and negative charge as described above. The charge control agent is used in a proportion of generally 0.01 to 10 parts by weight, preferably 0.1 to 5 parts by weight per 100 parts by weight of the polymerizable monomer for shell.

As examples of a specific process for polymerizing the polymerizable monomer for shell in the presence of the core particles, may be mentioned a process in which the polymerizable monomer for shell is added to the reaction system of the polymerization reaction which has been conducted for obtaining the core particles, thereby continuously conducting polymerization, and a process in which the core particles obtained in a separate reaction system are charged, to which the polymerizable monomer for shell is added, thereby conducting polymerization stepwise.

The polymerizable monomer for shell may be added to the reaction system in one lot, or continuously or intermittently by means of a pump such as a plunger pump.

In order to make easy to obtain polymer particles of core-shell structure, it is preferable to add a water-soluble radical initiator at the time the polymerizable monomer for shell is added. It is considered that when the water-soluble radical initiator is added upon the addition of the polymerizable monomer for shell, the log water-soluble initiator enters in the vicinity of each outer surface of the core particles to which the polymerizable monomer for shell has migrated, so that a polymer layer (shell) is easy to form on the core particle surface.

As examples of the water-soluble radical initiator, may be mentioned persulfates such as potassium persulfate and ammonium persulfate; azo initiators such as 4,4-azobis(4-cyanovaleric acid), 2,2-azobis(2-amidinopropane) bihydrochloride and 2,2-azobis-2-methyl-N-1,1-bis-(hydroxymethyl)-2-hydroxyethylpropionamide; and combinations of an oil-soluble initiator such as cumene peroxide with a redox catalyst. The amount of the water-soluble radical initiator used is generally 0.001 to 1 wt. % based on the aqueous medium.

Polymerized Toner

In the polymerized toner according to the present invention, a weight ratio of the polymerizable monomer for core to the polymerizable monomer for shell is generally 40/60 to 99.9/0.1, preferably 60/40 to 99.5/0.5, more preferably 80/20 to 99/1. If the proportion of the polymerizable monomer for shell is too low, the effect of improving the shelf stability becomes little. If the proportion is too high on the other hand, the effects of lowering the fixing temperature and improving the permeability through OHP become little.

The polymerized toner according to the present invention is composed of fine spherical particles sharp in particle diameter distribution in which the volume average particle diameter is generally 2 to 20 $\mu$m, preferably 3 to 15 $\mu$m, and the particle diameter distribution (volume average particle diameter/number average particle diameter) is generally at most 1.6, preferably at most 1.5.

The polymerized toner according to the present invention is composed of polymer particles of core-shell structure, comprising the core particles and the shell which covers each of the core particles. In the polymerized toner according to the present invention, the average thickness of the shell is generally 0.001 to 1 $\mu$m, preferably 0.005 to 0.5 $\mu$m. If the thickness of the shell is too great, the fixing ability of the toner is deteriorated. If the thickness is too small on the other hand, the shelf stability of the toner is deteriorated. The particle diameters of the core particles and the thickness of the shell in the polymerized toner can be determined by directly measuring the size and shell thickness of each of particles selected at random from electron photomicrographs thereof when they can be observed through an electron microscope. If the particle diameters of the core particles and the thickness of the shell are difficult to observe through the electron microscope, the particle diameters of the core particles are measured through the electron microscope in the same manner as described above or by means of a Coulter counter at the stage of formation of the core particles. After the core particles are then covered with the shell, the particle diameters of the resultant polymerized toner particles are measured again through the electron microscope or by means of the Coulter counter, whereby the average thickness of the shell can be found from changes in particle diameter before and after the covering with the shell. When it is difficult to measure the shell thickness by these methods, the thickness of the shell can be calculated out from the particle diameter of the core particles and the used amount of the polymerizable monomer for forming the shell.

The polymerized toner according to the present invention contains toluene-insoluble matter in an amount of generally at most 50 wt. %, preferably at most 20 wt. %, more preferably at most 10 wt. %. If the toluene-insoluble matter is contained in plenty, the fixing ability of the polymerized toner shows a tendency to lower. The toluene-insoluble matter is determined by placing a polymer component making up the polymerized toner in a 80-mesh woven metal basket, immersing the basket in toluene for 24 hours at room temperature, drying solids remaining in the basket by a vacuum drier and then measuring the weight of the dry solids to express it in terms of % by weight based on the weight of the polymer component.

The polymerized toner according to the present invention has a ratio (rl/rs) of the length (rl) to the breadth (rs) within a range of 1 to 1.2, preferably 1 to 1.15. If the ratio is too high, the resolution of an image formed from such a polymerized toner is deteriorated. In addition, when such a polymerized toner is contained in a toner container in an image forming apparatus, its durability shows a tendency to lower, since friction between particles of the polymerized toner becomes greater, and so external additives such as a flowability improver are separated from the toner.

The polymerized toner according to the present invention can be used as a developer as it is. However, it may also be used as a developer with various kinds of additives (external additives) such as a flowability improver added thereto as needed. The additives generally attach to the surface of the polymerized toner. As examples of the external additives, may be mentioned various kinds of inorganic particles and organic resin particles. Of these, silica particles and titanium oxide particles are preferred, with silica particles subjected to a hydrophobicity-imparting treatment being particularly preferred. In order to attach the external additives to the polymerized toner, in general, the external additives and the polymerized toner are charged into a mixer such as a Henschel mixer to mix them under stirring.

When the polymerized toner according to the present invention is used, the fixing temperature can be lowered to a low temperature of 80 to 150° C., preferably 80 to 130° C. In addition, the polymerized toner does not aggregate during its storage and is hence excellent in shelf stability.

Polymerized Toner Making Combined Use of at Least Two Parting Agents

When the parting agent (a) composed of the polyfunctional ester compound is used in combination with a parting agent (b) prepared by finely dispersing a hydrophobic material hardly soluble in a polymerizable monomer in water and then drying the resultant dispersion in the present invention, a polymerized toner, which has excellent offset resistance, shelf stability, flowability and fixing ability at low temperatures, has low dependence of the image quality of images formed thereby on environment and can provide prints of high image quality, can be obtained.

When the parting agent (a) is used in combination with the parting agent (b), it is preferred that the suspension polymerization temperature be preset to a temperature not higher than the endothermic peak temperature of the parting agent (a). These parting agents are contained in the core particles.

The parting agent (b) used in the present invention is obtained by treating a hydrophobic material generally used as a parting agent for toner. Such a hydrophobic material is hardly soluble in a polymerizable monomer in that its amount dissolved in 100 g of the polymerizable monomer for core is not more than 3 g, preferably not more than 2 g, more preferably not more than 1 g.

Examples of the hydrophobic material hardly soluble in the polymerizable monomer include low-molecular weight polyolefin waxes such as low-molecular weight polyethylene, low-molecular weight polypropylene and low-molecular weight polybutylene; terminal-modified polyolefin waxes such as low-molecular weight polypropylene oxidized at its molecular chain terminal, low-molecular weight polypropylene epoxy-modified at its molecular chain terminal, block copolymers of these low-molecular weight polypropylenes with low-molecular weight polyethylene, low-molecular weight polyethylene oxidized at its molecular chain terminal, low-molecular weight polyethylene epoxy-modified at its molecular chain terminal, and block copolymers of these low-molecular weight polyethylenes with low-molecular weight polypropylene; natural plant waxes such as candelilla, carnauba, rice, Japan wax and jojoba; petroleum waxes such as paraffin, microcrystalline and petrolatum, and modified waxes thereof; mineral waxes such as montan, ceresin and ozokerite; and synthetic waxes such as Fischer-Tropsch wax.

Of these, synthetic waxes such as Fischer-Tropsch wax, low-molecular weight polypropylene wax and microcrystalline wax are preferred. Examples of Fischer-Tropsch wax include "FT-100", "FT-0030", "FT-0050", "FT-0070", "FT-0165", "FT-1155" and "FT-60S" (all, trade names; products of Shell MDS Co.); and Sasol Wax (trade name, product of Sasol Co.). Examples of the low-molecular weight polypropylene include "Viscol 660P" and "Viscol 550P" (both, trade names; products of Sanyo Chemical Industries, Ltd.). Examples of the microcrystalline wax include "Hi-Mic-3090" (trade name, product of Nippon Seiro Co., Ltd.).

The hydrophobic material desirably shows an endothermic peak temperature upon heating within a range of generally 30 to 200° C., preferably 50 to 180° C., more preferably 60 to 160° C. on a DSC curve determined by means of a differential scanning calorimeter (DSC) in accordance with ASTM D 3418-8.

In the present invention, a product obtained by finely dispersing such a hydrophobic material hardly soluble in a polymerizable monomer in water and then drying the dispersion is used as the parting agent (b). In order to finely dispersing the hydrophobic material, the hydrophobic material is generally suspended in water to form an emulsion. Examples of a process for preparing the emulsion include a method in which the hydrophobic material is poured into water containing an emulsifier and stirred to emulsify it, and a method in which the hydrophobic material is heated and melted in water containing an emulsifier to emulsify it.

As a specific example of the dispersing method, water is first placed in a reaction vessel, and the hydrophobic material is then added in a proportion of generally 5 to 50 wt. %, preferably 5 to 30 wt. % based on water. As needed, an emulsifier is added in a proportion of generally 0.005 to 10 wt. %, preferably 0.5 to 5 wt. % based on water. As needed, an antioxidant is added, or nitrogen gas is hermetically introduced. While forcedly stirring, the aqueous mixture is then heated to a temperature higher than the melting point of the hydrophobic material by at least 10° C., thereby dissolving the hydrophobic material to finely disperse and emulsify. The use of the emulsifier is preferred because the hydrophobic material is easy to be finely dispersed. As a device for forcedly stirring the hydrophobic material, a homomixer, dispersion mixer, homogenizer or the like is used. After the formation of the emulsion, the resultant emulsion is cooled and dried.

As the emulsifier, there may be used various kinds of surfactants which are dissolved in water to lower the surface tension of water. Specific examples thereof are as follows. As nonionic surfactants, there may be used polyoxyethylene (10) cetyl ether, polyoxyethylene (15) cetyl ether, polyoxyethylene (20) cetyl ether, polyoxyethylene (25) cetyl ether, polyoxyethylene (30) cetyl ether, polyoxyethylene (35) cetyl ether, polyoxyethylene (40) cetyl ether, polyoxyethylene (10) stearyl ether, polyoxyethylene (15) stearyl ether, polyoxyethylene (20) stearyl ether, polyoxyethylene (25) stearyl ether, polyoxyethylene (30) stearyl ether, polyoxyethylene (35) stearyl ether, polyoxyethylene (40) stearyl ether, polyoxyethylene (10) oleyl ether, polyoxyethylene (15) oleyl ether, polyoxyethylene (20) oleyl ether, polyoxyethylene (25) oleyl ether, polyoxyethylene (30) oleyl ether, polyoxyethylene (35) oleyl ether, polyoxyethylene (40) oleyl ether, polyoxyethylene (9) nonylphenol, polyoxyethylene (15) nonylphenol, polyoxyethylene (20) nonylphenol, polyoxyethylene (25) nonylphenol, polyoxyethylene (30) nonylphenol, polyoxyethylene (35) nonylphenol and polyoxyethylene (40) nonylphenol. These surfactants are preferably solid at room temperature. Figures in the parentheses indicate the number of carbon atoms.

As anionic surfactants, there may be used soaps composed of morpholine and lauric acid, palmitic acid, stearic acid or oleic acid; soaps composed of methylmorpholine and lauric acid, palmitic acid, stearic acid or oleic acid; and soaps composed of ethylmorpholine and lauric acid, palmitic acid, stearic acid or oleic acid.

The dispersion of the hydrophobic material obtained by the emulsification is then dried to provide the parting agent (b) used in the present invention. The drying conditions may be optionally preset according to the kind of the hydrophobic material used. However, it is preferred that drying be conducted at a temperature or generally 30 to 45° C., preferably 30 to 40° C., more preferably 30 to 35° C. under reduced pressure. The degree of drying is such that the heating loss of the resulting parting agent (b) is generally 5% or lower, preferably 1% or lower, more preferably 0.5% or lower, most preferably 0.3% or lower. The heating loss can be determined by drying the parting agent (b) at 105° C. for 1 hour and dividing a difference in weight between before and after the drying by the weight of the parting agent before the drying to calculate a percentage thereof. As the drying method, there may also be used a method in which the dispersion is spray dried at a temperature lower than the melting point of the hydrophobic material, a method in which the dispersion is dried by means of a circulating drier (for example, flash jet drier or thermal jet drier manufactured by SEISHIN ENTERPRISE CO., LTD.), or the like.

The parting agent (b) may be mixed directly with the polymerizable monomer for core. However, it is preferred that the parting agent be mixed with a part or the whole of at least one monomer (for example, styrene monomer) used in the production of a toner, and the mixture is ground by a Beads Mill or the like to such a degree that the volume average particle diameter is generally 2 μm or smaller, preferably 1.5 μm or smaller, more preferably 1 μm or smaller as measured by a SALD-2000J (manufactured by Shimadzu Corporation). The lower limit of the volume average particle diameter is about 0.05 μm. The amount of the monomer used upon the grinding is generally 5 to 15 times, preferably 8 to 12 times by weight as much as the parting agent (b). When the particle diameter distribution of the parting agent (b) is narrow, the droplets of the polymerizable monomer composition become stable, and the shelf stability of the resulting toner is also improved. The stability of the droplets can be improved when the particle diameter distribution represented by a ratio, dv/dp of the volume average particle diameter, dv to the number average particle diameter, dp measured by the SALD-2000J (manufactured by Shimadzu Corporation) is generally 1.0 to 3.0, preferably 1.0 to 2.5, more preferably 1.0 to 2.0.

When the parting agent (a) and the parting agent (b) are used in combination, a weight ratio (a/b) between both agents is generally 99/1 to 50/50, preferably 95/5 to 55/45, more preferably 90/10 to 60/40. Both agents are used in combination at such a ratio, whereby excellent fixing ability and offset resistance can be achieved. The total proportion of the parting agents used is generally 0.1 to 40 parts by weight, preferably 1 to 30 parts by weight, more preferably 3 to 25 parts by weight per 100 parts by weight of the polymerizable monomer for core. A further parting agent may be used in a small proportion in combination with these parting agents as needed. Examples of the further parting agent include the above-described hydrophobic materials subjected to no treatment.

These parting agents are contained in the polymerizable monomer composition. The parting agents may be added to the polymerizable monomer composition at the same time or successively. Alternatively, these parting agents may be mixed with each other in advance, and the resultant mixture may be added. The processes for forming the core particles and shell by suspension polymerization, and the like are as described above.

However, the polymerization temperature is preferably preset to a temperature not higher than the endothermic peak temperature of the parting agent (a). The endothermic peak temperature of the parting agent (a) means an endothermic peak temperature shown on a DSC curve obtained by heating the parting agent at a rate of 10° C./min by means of a differential scanning calorimeter (DSC) in accordance with ASTM D 3418-8. The polymerization temperature is generally 30 to 200° C., preferably 35 to 95° C., and is preferably preset to a temperature within this range and not higher than the endothermic peak temperature of the parting agent (a). When the polymerization temperature is controlled like this, the parting agent component can be prevented from bleeding to the surface of the resulting polymerized toner, and at the same time the parting agent (a) comes to exist in the spherical or substantially spherical form in the interior of the polymerized toner. Therefore, a polymerized toner, which has excellent fixing ability, offset resistance, flowability, shelf stability and the like and has low dependence of the image quality of images formed thereby on environment, is easy to be provided.

A difference between the endothermic peak temperature of the parting agent (a) and the polymerization temperature may be optional so far as the parting agent (a) is melted in the reaction system, and is generally 0.5 to 60° C., preferably 1 to 50° C., more preferably 2 to 45° C. When the endothermic peak temperature of the parting agent (a) is high (70° C. or higher), the reaction effectively proceeds even if the difference with the polymerization temperature is great, since the polymerization temperature itself is sufficiently high. However, when the endothermic peak temperature is not very high (lower than 70° C.), it is preferred that a difference between the endothermic peak temperature and the polymerization temperature be preset smaller, since the proceeding of the polymerization reaction slows if the polymerization temperature is extremely lowered.

The sectional form of the parting agent (a) in the polymerized toner produced by such a process is generally spherical. A ratio (spheroidicity ratio) of a spheroidicity of the section of the parting agent (a) to a spheroidicity of the section of the polymerized toner (polymer particle) is preferably 1.0 to 1.5, more preferably 1.0 to 1.3. If the spheroidicity ratio is too high, the parting agent becomes easy to bleed to the surface of the polymerized toner, so that the flowability and shelf stability of the polymerized toner are deteriorated. Therefore, such a too high spheroidicity ratio is not preferred. On the other hand, a ratio of the sectional length of the parting agent (a) to the sectional length of the polymerized toner is preferably 0.3 to 0.7, more preferably 0.4 to 0.6. If this ratio is too high, the parting agent (a) becomes easy to bleed to the surface of the polymerized toner, so that the flowability and shelf stability of the polymerized toner are deteriorated. Therefore, such a too high length ratio is not preferred. The methods for obtaining the spheroidicity ratio and length ratio are described in Examples.

Image Forming Apparatus

An image forming apparatus, to which the polymerized toner according to the present invention is applied, comprises a photosensitive member (photosensitive drum), a means for charging the surface of the photosensitive member, a means for forming an electrostatic latent image on the surface of the photosensitive member, a means for receiving a toner (developer), a means for supplying the toner to develop the electrostatic latent image on the surface of the photosensitive member, thereby forming a toner image, and a means for transferring the toner image from the surface of the photosensitive member to a transfer medium. A specific example of such an image forming apparatus is illustrated in FIG. 1.

As illustrated in FIG. 1, in the image forming apparatus, a photosensitive drum 1 as the photosensitive member is installed rotatably in the direction of an arrow A. The photosensitive drum 1 has a structure that a photoconductive layer is provided around a peripheral surface of an electroconductive support drum. The photoconductive layer is composed of, for example, an organic photosensitive member, selenium photosensitive member, zinc oxide photosensitive member or amorphous silicon photosensitive member.

Around the photosensitive drum 1, a charging roll 2 as a charging means, a laser beam irradiating device 3 as a latent image forming means, a developing roll 4 as a developing means, a transfer roll 10 as a transfer means, and optionally a cleaning device (not illustrated) are arranged along the circumferential direction of the drum.

The charging roll 2 bears an action that the surface of the photosensitive drum 1 is evenly charged either positively or negatively. Voltage is applied to the charging roll 2, and the charging roll 2 is brought into contact with the surface of the photosensitive drum 1, thereby charging the surface of the photosensitive drum 1. The charging roller 2 may be replaced by a charging means according to corona discharge.

The laser beam irradiating device 3 bears an action that light corresponding to image signals is irradiated on the surface of the photosensitive drum 1 to expose the surface of the photosensitive drum 1 evenly charged to the light on the predetermined pattern, thereby forming an electrostatic latent image on the exposed portion of the drum (in the case of reversal development) or forming an electrostatic latent image on the unexposed portion of the drum (in the case of normal development). An example of other latent image forming means includes that composed of an LED array and an optical system.

The developing roll 4 bears an action that a toner is applied to the electrostatic latent image formed on the surface of the photosensitive drum 1. Bias voltage is applied between the developing roll 4 and the photosensitive drum 1 in such a manner that the toner is applied only to a light-exposed portion of the photosensitive drum 1 in reversal development, or only to a light-unexposed portion of the photosensitive drum 1 in normal development.

In a casing 9 for receiving the toner 7, the developing roll 4 and a feed roll 6 are arranged. The developing roll 4 is arranged in close vicinity to the photosensitive drum 1 in such a manner that a part thereof comes into contact with the photosensitive drum 1, and is rotated in a direction B opposite to the rotating direction of the photosensitive drum 1. The feed roll 6 is rotated in contact with and in the same direction C as the developing roll 4 to supply the toner 7 to the outer periphery of the developing roll 4. An agitating means (agitating blade) 8 for agitating the toner is installed in the casing 9.

A blade 5 for developing roll as a layer thickness regulating means is arranged at a position between the contact point with the feed roll 6 and the contact point with the photosensitive drum 1 on the periphery of the developing roll 4. The blade 5 is composed of conductive rubber or stainless steel, and voltage of |200 V| to |600 V| is generally applied to the blade to charge the toner. Therefore, the resistivity of the blade 5 is preferably $10^5$ Ωcm or lower.

The polymerized toner 7 according to the present invention is contained in the casing 9 of the image forming apparatus. The polymerized toner 7 may comprise additives such as a flowability improver attached thereto. Since the polymerized toner according to the present invention has a core-shell structure, and the shell of the surface layer is formed of a polymer having a relatively high glass transition temperature, the stickiness of the surface is reduced, and so the polymerized toner is prevented from aggregating during storage in the casing 9. In addition, since the particle diameter distribution of the polymerized toner according to the present invention is relatively sharp, the toner layer formed on the developing roll 4 can be made a substantially single layer by the layer thickness regulating means 5, thereby forming reproducible images with good quality.

The transfer roll 10 serves to transfer the toner image formed on the surface of the photosensitive drum 1 by the developing roll 4 to a transfer medium 11. Examples of the transfer medium 1 include paper and resin sheets such as OHP sheets. As transferring means, may be mentioned a corona discharge device and a transfer belt in addition to the transfer roll 10.

The toner image transferred to the transfer medium 11 is fixed to the transfer medium by a fixing means. The fixing means is generally composed of a heating means and a press-bonding means. More specifically, the fixing means is generally composed of the combination of a heating roll (fixing roll) 12 and a press roll 13. The transfer medium 11, to which the toner image has been transferred, is passed through between the heating roll 12 and the press roll 13 to melt the toner, and at the same time press-bond it to the transfer medium 11, thereby fixing the toner image thereto.

In the image forming apparatus according to the present invention, the polymerized toner according to the present invention is used as a toner. Therefore, the toner is easily melted even when the heating temperature by the heating means is low, and is fixed to the transfer medium in a flattened state by slightly pressing it by the press-bonding means, so that high-speed printing or copying is feasible. Further, the toner image fixed to an OHP sheet is excellent in permeability through OHP.

The cleaning device serves to clean off the toner remaining on the surface of the photosensitive drum 1 without transferring and is composed of, for example, a cleaning blade or the like. The cleaning device is not always required to install in the case where a system that cleaning is conducted by the developing roll 4 at the same time as development is adopted.

Image Forming Process

In the image forming process according to the present invention, which comprises the steps of applying a toner to the surface of a photosensitive member, on which an electrostatic latent image has been formed, to make the latent image visible, and then transferring the visible image to a transfer medium, the polymerized toner according to the present invention is used as the toner.

EXAMPLES

The present invention will hereinafter be described more specifically by the following Examples and Comparative Examples. However, the present invention is not limited to these examples only. Incidentally, all designations of "part" or "parts" and "%" as will be used in the following examples mean part or parts by weight and wt. % unless expressly noted.

Physical properties in the following Examples and Comparative Examples were measured in accordance with the following respective methods.

(1) Particle Diameter of Polymer

The volume average particle diameters (dv) of colored polymer particles (core particles) and polymer particles, and particle diameter distribution thereof, i.e., a ratio (dv/dp) of the volume average particle diameter to a number average particle diameter (dp) were measured by means of a Multisizer (manufactured by Coulter Co.). The measurement by the Multisizer was conducted under the following conditions:

aperture diameter: 50 μm;

medium: Isothone II, concentration: 15%; and number of particles measured: 50,000 particles.

(2) Thickness of Shell

In the examples of the present invention, the thickness of the shell in each toner sample was calculated out in the following equation though it can be measured by the Multisizer or an electron microscope where the thickness of the shell is great.

Thickness of shell (μm)=$dr(1+s/100\rho)^{1/3}-dr$ wherein dr is the radius of core particles before addition of a polymerizable monomer for shell (a half of the volume average particle diameter of the core particles found from measurement by the Multisizer), s is the number of parts of a polymerizable monomer for shell added (the number of parts per 100 parts by weight of a polymerizable monomer for core), and ρ is a density (g/cm$^3$) of a polymer making up the shell.

(3) Volume Resistivity of Toner

The volume resistivity of each toner sample was measured by means of a dielectric loss measuring device (TRS-10 Model, trade name; manufactured by Ando Electric Co., Ltd.) under conditions of a temperature of 30° C. and a frequency of 1 kHz.

(4) Fixing Temperature of Toner

A commercially available printer (4 papers per minutes printer and 8 papers per minutes printer) of a non-magnetic one-component development system was modified in such a manner that the temperature of a fixing roll can be varied. This modified printer was used to form an image with each toner sample, thereby evaluating the toner as to the image. A temperature at which a fixing rate of the toner amounted to 80% was defined as a fixing temperature. The fixing test was conducted by varying the temperature of the fixing roll in the printer to determine the fixing rate at each temperature, thereby finding a relationship between the temperature and the fixing rate. The fixing rate was calculated from the ratio of image densities before and after a peeling operation using a pressure-sensitive adhesive tape, which was conducted against a black solid-printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate is determined by the following equation:

$$\text{Fixing rate } (\%)=(ID_{after}/ID_{before})\times 100$$

In this test, the black solid-printed area means an area controlled in such a manner that the toner is caused to adhere to all dots within this area. The peeling operation of the pressure-sensitive adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

Incidentally, in the evaluation tests of various properties making use of the modified printer, a modified printer (4 papers per minutes printer; the number of copies per minute: 4 sheets) was used in Examples 1 to 12 and Comparative Examples 1 to 4, while another modified printer (8 papers per minutes printer; the number of copies per minute: 8 sheets) was used in Examples 13 to 21 and Comparative Examples 5 to 10.

(5) Shelf Stability of Toner

The evaluation of shelf stability was conducted by placing each toner sample in a closed container to seal it, sinking the container into a constant-temperature water bath controlled to 50° C. and then taking the container out of the water bath after a predetermined period of time (8 hours) went on, thereby measuring the weight of toner aggregated. The sample toner taken out of the container was transferred to a 42-mesh screen so as not to destroy the structure thereof as much as possible, and the screen was vibrated for 30 seconds by means of a powder measuring device, REOSTAT (manufactured by Hosokawa Micron Corporation) with the intensity of vibration preset to 4.5. Thereafter, the weight of the toner remaining on the screen was measured to regard it as the weight of the toner aggregated. The aggregation rate (wt. %) of the toner was calculated out from this weight of the aggregated toner and the weight of the sample. The aggregation rate of the toner was determined 3 times per sample to find an average value thereof.

The shelf stability of the toner sample was evaluated by 4 ranks in accordance with the following standard:

◎: aggregation rate was lower than 5 wt. %;

○: aggregation rate was not lower than 5 wt. %, but low than 10 wt. %;

Δ: aggregation rate was not lower than 10 wt. %, but low than 50 wt. %; and

×: aggregation rate was not lower than 50 wt. %.

(6) Permeability Through OHP

The temperature of the fixing roll in the modified printer described above was preset to 150° C. to conduct printing with each toner sample on a commercially available OHP sheet (Transparency, product of Uchida Yoko Co., Ltd.), thereby evaluating the toner sample as to permeability through OHP. Whether the printed image permeated through the OHP sheet or not was visually observed, thereby ranking it as ○ where the image permeated, or × where the image did not permeate.

(7) Charge Level of Toner

The charge level of each toner sample was measured under respective environments of L/L (10° C. in temperature and 20% in humidity, RH) and H/H (30° C. in temperature and 80% in humidity, RH) to evaluate the toner sample as to charge level under varied environments.

The charge level of the toner was determined in the following manner. The toner was charged into a commercially available printer (4-sheet printer) under each of the above-described environments and left to stand for 24 hours. Thereafter, a print pattern of half tone was printed 5 times, and the toner on a developing roll was then sucked in a suction type charge level meter to measure a charge level per unit weight from the charge level and weight of the toner sucked at this time. The charge level of the toner under a room temperature environment (23° C. in temperature and 50% in humidity, RH) was determined in the same manner as described above.

(8) Evaluation of Image Quality (Durability)

The above-described modified printer was used to conduct continuous printing with each toner sample from the beginning under a room temperature environment (23° C. in temperature and 50% in relative humidity, RH) to count the number of printed sheets that retained an image density of 1.3 or higher as measured by a reflection densitometer (manufactured by McBeth Co) and at an unprinted area, fog of 10% or lower as measured by a whiteness meter (manufactured by Nippon Denshoku K.K.), thereby evaluating the toner sample as to image quality in accordance with the following standard:

○: the number of the printed sheets was 10,000 or more;

Δ: the number of the printed sheets was not less than 5,000, but less than 10,000; and ×: the number of the printed sheets was less than 5,000.

(9) Volume Average Particle Diameter of Parting Agent (b)

The volume average particle diameter (dv) of each parting agent is a value determined in a state of a dispersion before drying. This measurement was conducted by means of an SALD-2000J (manufactured by Shimadzu Corporation). Specifically, a parting agent (b) dispersed in styrene was dispersed for 3 minutes by an ultrasonic cleaner. The resultant dispersion of the parting agent was added dropwise into a measuring quartz cell filled with styrene in advance to conduct the measurement under conditions that the amount of the dispersion added is controlled in such a manner that the absorbance measured by the SALD-2000J amounts to 0.1 to 0.2, and irradiation with laser is then conducted for 2 seconds.

(10) Spheroidicity Ratio

A polymer particle sample was embedded by an aqueous embedding compound to prepare an ultrathin section by a freezing method. The ultrathin section was placed on a collodion film-attached mesh to observe it through a transmission electron microscope. Fifty samples in total were observed to measure the sectional length (dtl) and breadth (dts) of the polymer perticle, thereby determining a spheroidicity $\alpha$ ($\alpha$=dtl/dts) of the section of the polymer particle. At the same time, the sectional length (dll) and breadth (dls) of the parting agent (a) were measured to determine a spheroidicity $\beta$ ($\beta$=dll/dls) of the section of the parting agent (a). The average value of a spheroidicity ratio was then calculated out in accordance with the following equation:

$$\text{Spheroidicity ratio}=\beta/\alpha$$

(11) Length Ratio

The sectional length (dtl) of a polymer particle and the sectional length (dll) of a parting agent contained in the same polymer particle were measured in the same manner as the measuring method of the spheroidicity ratio to calculate out a length ratio (dll/dtl), thereby finding an average value of 50 samples in total.

(12) Endothermic Peak Temperature

The endothermic peak temperature of a parting agent sample was measured by means of a differential scanning calorimeter (DSC) in accordance with ASTM D 3418-8. A DSC curve is a curve obtained by heating the sample at a rate of 10° C./min. When the endothermic peak is broad, a temperature corresponding to the top of the peak was regarded as the endothermic peak temperature. "SSC5200" (manufactured by Seiko Instruments, Inc.) was used as the differential scanning calorimeter.

(13) Heating Loss

After a parting agent sample was dried at 105° C. for 1 hour, a difference in weight between before and after the drying was determined. The value of the difference in weight thus obtained was divided by the weight of the parting agent before the drying to find a percentage (unit: %) thereof.

(14) Offset Temperature

The temperature of a fixing roll was varied in the same manner as in the measuring method of the fixing temperature of toner to print a black solid image, thereby regarding a temperature of the fixing roll, at which offset occurred, as an offset temperature.

(15) Flowability

Three screens having screen openings of 150 μm, 75 μm and 45 μm, respectively, were stacked in that order from the top, and 4 g of a developer sample to be determined were precisely weighed and placed on the uppermost screen. After the three screens thus stacked were vibrated for 15 seconds under conditions of a vibration intensity of 4 by means of a powder measuring device ("Powder Tester", trade name, manufactured by Hosokawa Micron Corporation), the weight of the developer remaining on each screen was measured. The respective measured values were substituted in the following equations to calculate out a value-of flowability. The measurement was conducted 3 times per sample to find an average value thereof.

Equations for calculation:

$a$=(Weight (g) of developer remaining on the screen of 150 μm)/4g×100

$b$=(Weight (g) of developer remaining on the screen of 75 μm)/4g×100×0.6

$c$=(Weight (g) of developer remaining on the screen of 45 μm)/4g×100×0.2

Flowability (%)=100−($a$+$b$+$c$)

(16) Dependence of Image Quality on Environment

The above-described modified printer was used to conduct continuous printing with each developer sample from the beginning under environments of 35° C.×80% RH (H/H) and 10° C.×20% RH (L/L) to count the number of printed sheets that retained an image density of 1.3 or higher as measured by a reflection densitometer (manufactured by McBeth Co) and at an unprinted area, fog of 10% or lower as measured by a whiteness meter (manufactured by Nippon Denshoku K.K.), thereby evaluating the dependence of the quality of an image formed by the developer on environment in accordance with the following standard:

○: the number of the printed sheets that retained the above image quality was 10,000 or more;

Δ: the number of the printed sheets that retained the above image quality was not less than 5,000, but less than 10,000; and ×: the number of the printed sheets that retained the above image quality was less than 5,000.

Example 1

Stirred and mixed at 12,000 rpm in a homomixer (TK type, manufactured by Tokushu Kika Kogyo Co., Ltd.) capable of mixing with high shearing force were a polymerizable monomer (calculated Tg of the resulting copolymer=50° C.) for core composed of 78 parts of styrene and 22 parts of n-butyl acrylate, 7 parts of carbon black (Printex 150T, trade name; product of Degussa AG), 1 part of a charge control agent (Spiron Black TRH, trade name; product of Hodogaya Chemical Co., Ltd.), 0.3 parts of divinylbenzene, 0.8 parts of a polymethacrylic ester macromonomer (AA6, trade name; Tg=94° C.; product of Toagosei Chemical Industry Co., Ltd.), 10 parts of pentaerythritol tetrastearate (purity of stearic acid: about 60%) and 4 parts of t-butyl peroxy-2-ethylhexanoate, thereby uniformly dispersing them to obtain a polymerizable monomer composition (liquid mixture) for core.

On one hand, 10 parts of methyl methacrylate (calculated Tg of the resulting polymer=105° C.) and 100 parts of water were subjected to a finely dispersing treatment by an ultrasonic emulsifier, thereby obtaining an aqueous dispersion of a polymerizable monomer for shell. The droplet diameter of droplets of the polymerizable monomer for shell was found to be 1.6 μm in terms of $D_{90}$ as determined by means of a microtrack particle diameter distribution measuring device by adding the droplets at a concentration of 3% to a 1% aqueous solution of sodium hexametaphosphate.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metallic salt) dissolved in 250 parts of ion-exchanged water under stirring to prepare a dispersion of colloid of magnesium hydroxide (colloid of hardly water-soluble metal hydroxide). The particle diameter distribution of the colloid formed was measured by means of the microtrack particle diameter distribution measuring device (manufactured by Nikkiso Co., Ltd.) and found to be 0.38 μm in terms of $D_{50}$ (50% cumulative value of number particle diameter distribution) and 0.82 μm in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

The polymerizable monomer composition for core prepared above was then poured into the colloidal dispersion of magnesium hydroxide obtained above, and the resultant mixture was stirred at 12,000 rpm under high shearing force by means of the TK type homomixer, thereby forming droplets of the polymerizable monomer composition for core. The thus-prepared aqueous dispersion containing droplets of the monomer composition for core was charged into a reactor equipped with an agitating blade to initiate a polymerization reaction at 90° C. At the time a conversion into a polymer reached almost 100%, the polymerizable monomer for shell prepared above and 1 part of a 1% aqueous solution of potassium persulfate were added to continue the reaction for 5 hours. Thereafter, the reaction was stopped to obtain an aqueous dispersion containing polymer particles of core-shell structure.

The volume average particle diameter (dv) of core particles measured by taking out them just before the polymerizable monomer for shell was added was 5.7 μm, and a ratio of the volume average particle diameter (dv) to the number average particle diameter (dp) thereof was 1.32. The resultant polymer particles had a shell thickness of 0.09 μm and an rl/rs ratio of 1.1 and contained 2% of toluene-insoluble matter.

While stirring the above-obtained aqueous dispersion of the polymer particles of core-shell structure, the pH of the system was adjusted to 4 or lower with sulfuric acid to conduct acid washing (25° C., 10 minutes). After water was separated by filtration from the dispersion, 500 parts of ion-exchanged water were newly added to form a slurry again, and the slurry was washed with water. Thereafter, the dehydration and water washing were repeated several times, and solids were then collected by filtration. The thus-collected solids were dried at 45° C. for 24 hours by a dryer to obtain polymer particles (polymerized toner).

To 100 parts of the polymerized toner of core-shell structure obtained above were added 0.3 parts of colloidal silica (R-972, trade name; product of Nippon Aerosil Co., Ltd.) subjected to a hydrophobicity-imparting treatment, and they were mixed by means of a Henschel mixer to prepare a non-magnetic one-component developer (hereinafter referred to as a developer or toner merely). The volume resistivity of the toner thus obtained was measured and found to be 11.3 logΩ·cm.

The toner thus obtained was used to measure its fixing temperature. As a result, it was 120° C. The shelf stability of the toner was extremely good (rank=◎). The evaluation of image revealed that an image high in image density, free of fog and irregularities, and extremely good in resolution was obtained. The results are shown in Table 1.

Example 2

A polymerized toner and a developer (toner) were obtained in the same manner as in Example 1 except that the amount of pentaerythritol tetrastearate used in Example 1 was changed to 5 parts. The evaluation of image revealed that an image high in image density, free of fog and irregularities, and extremely good in resolution was obtained. The results are shown in Table 1.

Example 3

A polymerized toner and a developer (toner) were obtained in the same manner as in Example 1 except that pentaerythritol tetrastearate used in Example 1 was changed to glycerol triarachidate (purity of arachidic acid: about 60%). The results are shown in Table 1.

Comparative Example 1

A polymerized toner and a developer (toner) were obtained in the same manner as in Example 1 except that pentaerythritol tetrastearate used in Example 1 was changed to paraffin wax having a melting point of 60° C. The results are shown in Table 1.

Comparative Example 2

A polymerized toner and a developer (toner) were obtained in the same manner as in Example 1 except that pentaerythritol tetrastearate used in Example 1 was changed to low molecular weight polypropylene having a number average molecular weight of 2,200. The results are shown in Table 1.

TABLE 1

| | Example | | | Comp. Ex. | |
|---|---|---|---|---|---|
| | 1 | 2 | 3 | 1 | 2 |
| Core particles: | | | | | |
| dv [μm] | 5.7 | 5.7 | 6.1 | 6.5 | 6.0 |
| dv/dp | 1.32 | 1.28 | 1.25 | 1.35 | 1.22 |
| Polymer particles: | | | | | |
| Thickness of shell [μm] | 0.09 | 0.09 | 0.09 | 0.10 | 0.10 |
| Toluene-insoluble matter [%] | 2 | 3 | 3 | 2 | 4 |
| Evaluation of toner: | | | | | |
| dv [μm] | 5.9 | 5.9 | 6.3 | 6.7 | 6.2 |
| dv/dp | 1.30 | 1.30 | 1.28 | 1.36 | 1.24 |
| Volume resistivity [logΩcm] | 11.3 | 11.4 | 11.2 | 11.0 | 11.4 |
| Fixing temperature [° C.] | 120 | 130 | 130 | 150 | 160 |
| Shelf stability | ◎ | ◎ | ◎ | Δ | Δ |
| Charge level under L/L [μc/g] | −26 | −24 | −28 | −25 | −27 |
| Charge level under H/H [μc/g] | −16 | −25 | −25 | −20 | −25 |
| Evaluation of image quality | ○ | ○ | ○ | X | Δ |

Comparative Example 3

Four parts of saturated polyester, 83 parts of styrene, 17 parts of butyl acrylate, 7 parts of carbon black, 1 part of a metal compound of salicylic acid and 10 parts of pentaerythritol dibehenate diacetate were dispersed by means of the TK type homomixer, and 5 parts of 2,2'-azobis(2,4-dimethylvaleronitrile) were added to the resultant dispersion, thereby preparing a polymerizable monomer composition. After the polymerizable monomer composition was then granulated, it was heated to 60° C. to conduct polymerization for 10 hours. After the polymerization, the formed product was washed and dried to obtain polymer particles (polymerized toner). A developer (toner) was obtain in the same manner as in Example 1 except that this polymerized toner was used. The results are shown in Table 2.

Example 4

A polymerized toner and a developer (toner) were obtained in the same manner as in Example 1 except that 10 parts of methyl methacrylate used as the polymerizable monomer for shell in Example 1 were changed to 9 parts of methyl methacrylate and 1 part of butyl acrylate. The evaluation results are shown in Table 2.

Example 5

A polymerized toner and a developer (toner) were obtained in the same manner as in Example 1 except that 10 parts of styrene were used in place of 10 parts of methyl methacrylate used as the polymerizable monomer for shell in Example 1, and 20 parts of methanol were added just before the polymerizable monomer for shell was added. The evaluation results are shown in Table 2.

Example 6

A polymerized toner and a developer (toner) were obtained in the same manner as in Example 1 except that 2,2-azobisisobutyronitrile was used in place of t-butyl peroxy-2-ethylhexanoate used as the polymerization initiator for the polymerizable monomer for core in Example 1, and the reaction temperature was changed to 75° C. The results are shown in Table 2. When this developer was used to conduct fixing, slight odor was given off.

Example 7

A polymerized toner and a developer (toner) were obtained in the same manner as in Example 1 except that the polymerizable monomer for shell was added without conducting the treatment by means of the ultrasonic emulsifier in Example 1. The results are shown in Table 2.

TABLE 2

| | Example | | | | Comp. Ex. |
|---|---|---|---|---|---|
| | 4 | 5 | 6 | 7 | 3 |
| Core particles: | | | | | |
| dv [μm] | 6.0 | 6.1 | 6.9 | 6.5 | 6.2 |
| dv/dp | 1.27 | 1.31 | 1.35 | 1.40 | 1.38 |
| Polymer particles: | | | | | |
| Thickness of shell [μm] | 0.10 | 0.10 | 0.09 | 0.10 | 0.09 |
| Toluene-insoluble matter [%] | 3 | 3 | 5 | 4 | 4 |
| Evaluation of toner: | | | | | |
| dv [μm] | 6.2 | 6.3 | 6.1 | 6.7 | 6.4 |
| dv/dp | 1.27 | 1.31 | 1.33 | 1.40 | 1.37 |
| Volume resistivity [logΩcm] | 11.3 | 11.4 | 11.2 | 11.1 | 11.1 |
| Fixing temperature [° C.] | 120 | 130 | 130 | 130 | 140 |
| Shelf stability | ◎ | ◎ | ◎ | ○ | X |
| Charge level under L/L [μc/g] | −27 | −30 | −22 | −23 | −20 |
| Charge level under H/H [μc/g] | −22 | −27 | −18 | −19 | −17 |
| Evaluation of image quality | ○ | ○ | ○ | ○ | X |

Example 8

A polymerized toner and a developer (toner) were obtained in the same manner as in Example 1 except that butyl acrylate used as the polymerizable monomer for core in Example 1 was changed to 2-ethylhexyl acrylate. The results are shown in Table 3.

Example 9

A polymerized toner and a developer (toner) were obtained in the same manner as in Example 1 except that 5 parts of a magenta pigment (Pigment Red 122) were used in place of 7 parts of carbon black used in Example 1. The results are shown in Table 3.

Example 10

A polymerized toner and a developer (toner) were obtained in the same manner as in Example 1 except that 5 parts of a yellow quinophthalone pigment (Pigment Yellow 138) were used in place of 7 parts of carbon black used in Example 1. The results are shown in Table 3.

Example 11

A polymerized toner and a developer (toner) were obtained in the same manner as in Example 1 except that 5 parts of a cyan pigment (Pigment Blue 15:3) were used in place of 7 parts of carbon black used in Example 1. The results are shown in Table 3.

Comparative Example 4

A polymerized toner and a developer (toner) were obtained in the same manner as in Comparative Example 1 except that 5 parts of a magenta pigment (Pigment Red 122) were used in place of 7 parts of carbon black used in Example 1. The results are shown in Table 3.

TABLE 3

| | Example | | | | Comp. Ex. |
|---|---|---|---|---|---|
| | 8 | 9 | 10 | 11 | 4 |
| Core particles: | | | | | |
| dv [μm] | 6.3 | 6.1 | 6.2 | 6.5 | 5.9 |
| dv/dp | 1.21 | 1.18 | 1.25 | 1.31 | 1.27 |
| Polymer particles: | | | | | |
| Thickness of shell [μm] | 0.10 | 0.10 | 0.10 | 0.10 | 0.09 |
| Toluene-insoluble matter [%] | 3 | 4 | 5 | 6 | 4 |
| Evaluation of toner: | | | | | |
| dv [μm] | 6.5 | 6.3 | 6.4 | 6.7 | 6.1 |
| dv/dp | 1.22 | 1.17 | 1.24 | 1.29 | 1.27 |
| Volume resistivity [logΩcm] | 11.4 | 12.5 | 12.4 | 11.6 | 12.4 |
| Fixing temperature [° C.] | 120 | 130 | 120 | 130 | 130 |
| Shelf stability | ◎ | ◎ | ◎ | ◎ | Δ |
| Charge level under L/L [μc/g] | −28 | −32 | −34 | −28 | −33 |
| Charge level under H/H [μc/g] | −25 | −30 | −31 | −25 | −29 |
| Permeability through OHP | — | ○ | ○ | ○ | ○ |
| Evaluation of image quality | ○ | ○ | ○ | ○ | X |

Example 12

A polymerized toner and a developer (toner) were obtained in the same manner as in Example 1 except that pentaerythritol tetramyristate was used in place of pentaerythritol tetrastearate used in Example.

The volume average particle diameter (dv) of core particles measured by taking out them just before the polymerizable monomer for shell was added was 5.8 μm, and a ratio of the volume average particle diameter (dv) to the number average particle diameter (dp) thereof was 1.22. The resultant polymer particles had a shell thickness of 0.09 μm and an rl/rs ratio of 1.1 and contained 2% of toluene-insoluble matter.

The volume resistivity of the non-magnetic one-component developer (toner) obtained by adding colloidal silica subjected to the hydrophobicity-imparting treatment to the polymerized toner was 11.3 logΩ·cm. The toner was used to measure its fixing temperature. As a result, it was 120° C. The shelf stability of the toner was extremely good (rank=◎). The toner had charge levels of −28 μc/g and −25 μc/g under L/L and H/H environments, respectively. The evaluation of image revealed that an image high in image density, free of fog and irregularities, and extremely good in resolution was obtained (rank of image quality=○).

Incidentally, pentaerythritol tetramyristate was excellent in solubility in the polymerizable monomer compared with pentaerythritol tetrastearate, and so there was no need to grind or melt it in advance for enhancing the solubility at room temperature.

Referential Example 1

A jacketed reactor was charged with 100 parts of water, and 20 parts of Fischer-Tropsch wax ("FT-100", trade name;

product of Shell MDS Co.) derived from natural gas and 3 parts of polyoxyethylene (20) cetyl ether were then added thereto. The resultant mixture was heated to 130° C. under nitrogen and then forcedly stirred by a homomixer to emulsify it. The volume average particle diameter (dv) of the Fischer-Tropsch wax derived from natural gas in the emulsion was measured and found to be 0.45 μm. This emulsion was quenched and then placed in a vacuum drier to dehydrate and dry it at 35° C. under reduced pressure, thereby obtaining Parting Agent (b-1).

Referential Example 2

Parting Agent (b-2) was obtained in the same manner as in Referential Example 1 except that low-molecular weight polypropylene wax ("Viscol 660P", trade name; product of Sanyo Chemical Industries, Ltd.) was used in place of the Fischer-Tropsch wax derived from natural gas, and the emulsification was conducted at 160° C. The volume average particle diameter (dv) of the low-molecular weight polypropylene wax in the emulsion was 0.44 μm.

Referential Example 3

Parting Agent (b-3) was obtained in the same manner as in Referential Example 1 except that microcrystalline wax ("Hi-Mic-3090", trade name; product of Nippon Seiro Co., Ltd.) was used in place of the Fischer-Tropsch wax derived from natural gas, and the emulsification was conducted at 125° C. The volume average particle diameter (dv) of the microcrystalline wax in the emulsion was 0.45 μm.

Example 13

After a polymerizable monomer (calculated Tg of the resulting copolymer=55° C.) for core composed of 80.5 parts of styrene and 11.5 parts of n-butyl acrylate, 7 parts of carbon black ("#25", trade name; product of Mitsubishi Kagaku Co., Ltd.), 1 part of a charge control agent ("Spiron Black TRH", trade name; product of Hodogaya Chemical Co., Ltd.), 0.3 parts of divinylbenzene, 0.5 parts of a polymethacrylic ester macromonomer ("AA6", trade name; Tg=94° C.; product of Toagosei Chemical Industry Co., Ltd.), 15 parts of pentaerythritol tetramyristate and 2 parts of Parting Agent (b-1) prepared in Referential Example 1 were mixed, the mixture was uniformly dispersed by a media type dispersing machine to prepare a polymerizable monomer composition for core. The preparation of this composition was conducted at room temperature throughout the operation. Incidentally, the amount of pentaerythritol tetramyristate [hereinafter referred to as "Parting Agent (a-1)"] dissolved in 100 g of the polymerizable monomer for core at 30° C. was at least 10 g.

On the other hand, an aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of colloid of magnesium hydroxide (colloid of hardly water-soluble metal hydroxide). The preparation of the dispersion was conducted at room temperature throughout the operation. The particle diameter distribution of the colloid formed was measured by means of the microtrack particle diameter distribution measuring device (manufactured by Nikkiso Co., Ltd.) and found to be 0.36 μm in terms of $D_{50}$ (50% cumulative value of number particle diameter distribution) and 0.80 μm in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

After the polymerizable monomer composition for core prepared above was poured into the colloidal dispersion of magnesium hydroxide obtained above at room temperature, and the mixture was stirred until droplets became stable, 6 parts of t-butyl peroxyneodecanoate ("Perbutyl ND", trade name; product of Nippon Oil & Fats Co., Ltd.) were added, and the resultant mixture was further stirred at 15,000 rpm under high shearing force by means of an Ebara Milder ("MDN 303V Model", trade name; manufactured by Ebara Corporation), thereby forming droplets of the polymerizable monomer composition. The thus-prepared aqueous dispersion containing droplets of the polymerizable monomer composition was charged into a 10-liter reactor equipped with an agitating blade to initiate a polymerization reaction at 60° C. At the time a conversion into a polymer reached almost 100%, sampling was conducted to measure the particle diameter of colored polymer particles (core particles) formed. As a result, the volume average particle diameter (dv) of the core particles was 6.4 μm, and a ratio of the volume average particle diameter (dv) to the number average particle diameter (dp) thereof was 1.28.

Three parts of methyl methacrylate (calculated Tg of the resulting polymer=105° C.) and 30 parts of water were subjected to a finely dispersing treatment at room temperature by an ultrasonic emulsifier, thereby preparing an aqueous dispersion of a polymerizable monomer for shell. The droplet diameter of droplets of the polymerizable monomer for shell was found to be 1.6 μm in terms of $D_{90}$ as determined by means of a microtrack particle diameter distribution measuring device by adding the droplets at a concentration of 3% to a 1% aqueous solution of sodium hexametaphosphate.

A mixture of the dispersion of the polymerizable monomer for shell prepared above, 0.3 parts of a water-soluble initiator (ammonium persulfate, product of Mitsubishi Gas Chemical Company, Inc.) and 65 parts of distilled water was added to the reactor in which the core particles were present, and the reaction was continued for 4 hours. Thereafter, the reaction was stopped to obtain an aqueous dispersion (pH=9.5) containing polymer particles of core-shell structure formed.

While stirring the above-obtained aqueous dispersion of the polymer particles of core-shell structure at room temperature, the pH of the system was adjusted to 4 or lower with sulfuric acid to conduct acid washing (25° C., 10 minutes). After water was separated by filtration from the dispersion, 500 parts of ion-exchanged water were newly added to form a slurry again, and the slurry was washed with water. -Thereafter, the dehydration and water washing were repeated several times, and solids were then collected by filtration. The thus-collected solids were dried at 45° C. for 24 hours by a dryer to recover polymer particles of core-shell structure.

The volume average particle diameter (dv) of the thus-obtained polymer particles of core-shell structure was 6.5 μm, and a ratio of the volume average particle diameter (dv) to the number average particle diameter (dp) thereof was 1.30. The thickness of the shell calculated out from the amount of the polymerizable monomer for shell and the particle diameter of the core particles was 0.03 μm. A ratio of a spheroidicity of the section of Parting Agent (a-1) to a spheroidicity of the section of the polymer particle of core-shell structure was 1.2. A ratio of the sectional length of Parting Agent (a-1) to the sectional length of the polymer particle of core-shell structure was 0.6. The endothermic peak temperature of Parting Agent (a-1) determined by the DSC measurement was 63° C. (endothermic peak temperature−polymerization temperature =3° C.).

To 100 parts of the polymer particles of core-shell structure obtained above were added 0.6 parts of colloidal silica ("R-972", trade name; product of Nippon Aerosil Co., Ltd.) subjected to a hydrophobicity-imparting treatment, and they were mixed by means of a Henschel mixer to prepare a non-magnetic one-component developer (referred to as a developer or toner merely). The volume resistivity of the toner thus obtained was measured and found to be 11.3 logΩ·cm.

The toner thus obtained was used to measure its fixing temperature. As a result, it was 120° C. The shelf stability and flowability of the toner were extremely good. The evaluation of the image formed by this toner revealed that an image high in image density, free of fog and irregularities, and extremely good in resolution was obtained. The results are shown in Table 4.

Example 14

Polymer particles of core-shell structure and a toner were obtained in the same manner as in Example 13 except that pentaerythritol tetrapalmitate was used in place of pentaerythritol tetramyristate [Parting Agent (a-1)] in Example 13.

The amount of pentaerythritol tetrapalmitate [hereinafter referred to as "Parting Agent (a-2)"] dissolved in 100 g of the polymerizable monomer for core at 30° C. was at least 10 g. The endothermic peak temperature of Parting Agent (a-2) determined by the DSC measurement was 65° C. (endothermic peak temperature−polymerization temperature=5° C.). The results are shown in Table 4.

Example 15

Polymer particles of core-shell structure and a toner were obtained in the same manner as in Example 13 except that pentaerythritol tetralaurate was used in place of pentaerythritol tetramyristate [Parting Agent (a-1)] in Example 13, t-butyl peroxyneodecanoate of the polymerization initiator was changed to 1,1,3,3-tetramethylbutyl peroxyneodecanoate ("Perocta ND", trade name; product of Nippon Oil & Fats Co., Ltd.), and the polymerization temperature was changed from 60° C. to 50° C.

The amount of pentaerythritol tetralaurate [hereinafter referred to as "Parting Agent (a-3)"] dissolved in 100 g of the polymerizable monomer for core at 30° C. was at least 10 g. The endothermic peak temperature of Parting Agent (a-3) determined by the DSC measurement was 53° C. (endothermic peak temperature−polymerization temperature=3° C.). The results are shown in Table 4.

Comparative Example 5

Polymer particles of core-shell structure and a toner were obtained in the same manner as in Example 13 except that low-molecular weight polypropylene was used in place of pentaerythritol tetramyristate [Parting Agent (a-1)] in Example 13.

The amount of low-molecular weight polypropylene dissolved in 100 g of the polymerizable monomer for core at 30° C. was less than 1 g. The endothermic peak temperature of low-molecular weight polypropylene determined by the DSC measurement was 65° C. (endothermic peak temperature−polymerization temperature=5° C.). The results are shown in Table 4.

TABLE 4

| | Example | | | Comp. Ex. |
|---|---|---|---|---|
| | 13 | 14 | 15 | 5 |
| Particle diameter of core particles (μm) | 6.4 | 6.6 | 6.4 | 6.5 |
| Thickness of shell (μm) | 0.03 | 0.03 | 0.03 | 0.03 |
| Parting Agent (a): | a-1 | a-2 | a-3 | |
| Amount (part) | 15 | 15 | 15 | — |
| Spheroidicity ratio | 1.2 | 1.2 | 1.2 | |
| Length ratio | 0.6 | 0.6 | 0.5 | |
| Endothermic peak (° C.) | 63 | 65 | 53 | |
| Parting Agent: | — | — | — | Low-mol. wt. PP |
| Amount (part) | | | | 15 |
| Parting Agent (b): | b-1 | b-1 | b-1 | b-1 |
| Amount (part) | 2 | 2 | 2 | 2 |
| Heating loss (%) | 0.3 | 0.3 | 0.3 | 0.3 |
| Evaluation of toner: | | | | |
| dv (μm) | 6.5 | 6.7 | 6.5 | 6.6 |
| dv/dp | 1.30 | 1.28 | 1.26 | 1.24 |
| Volume resistivity (logΩ · cm) | 11.3 | 11.4 | 11.3 | 11.4 |
| Charge level (μc/g) (23° C., 50% RH) | −35 | −37 | −33 | −38 |
| Fixing temperature (° C.) | 125 | 130 | 120 | 150 |
| Offset temperature (° C.) | 200 | 200 | 200 | 210 |
| Shelf stability (%) | ◎ | ◎ | ◎ | Δ |
| Flowability (%) | 64 | 68 | 60 | 38 |
| Dependence of image quality on environment | | | | |
| (H/H) | ○ | ○ | ○ | Δ |
| (L/L) | ○ | ○ | ○ | ○ |
| Durability of image quality | ○ | ○ | ○ | X |

(Note)
(1) a-1: Pentaerythritol tetramyristate
(2) a-2: Pentaerythritol tetrapalmitate
(3) a-3: Pentaerythritol tetralaurate
(4) b-1: Fischer-Tropsch wax derived from natural gas

Example 16

Polymer particles of core-shell structure and a toner were obtained in the same manner as in Example 13 except that Parting Agent (b-2) prepared in Referential Example 2 was used in place of Parting Agent (b-1) in Example 13. The results are shown in Table 5.

Example 17

Polymer particles of core-shell structure and a toner were obtained in the same manner as in Example 16 except that the amount of pentaerythritol tetramyristate [Parting Agent (a-1)] in Example 16 was changed from 15 parts to 10 parts. The results are shown in Table 5.

Example 18

Polymer particles of core-shell structure and a toner were obtained in the same manner as in Example 16 except that the amount of pentaerythritol tetramyristate [Parting Agent (a-1)] in Example 16 was changed from 15 parts to 20 parts. The results are shown in Table 5.

Comparative Example 6

A liquid dispersion obtained by mixing 300 parts of untreated paraffin wax into 2,700 parts of styrene was subjected to a grinding treatment for 6 hours by means of a Dyno Mill ("KDL-PILOT", internal volume: 1.4 liters; manufactured by Willy A. Bakohen Co.) to grind the paraffin wax into fine particles having a volume average particle diameter of 2.7 μm (particle diameter distribution, Dv/Dp= 6.8).

Polymer particles of core-shell structure and a toner were obtained in the same manner as in Example 16 except that the fine particles of paraffin wax were used in place of pentaerythritol tetramyristate [Parting Agent (a-1)] in Example 16 so as to amount to 15 parts. The fixing temperature of the toner thus obtained was 140° C. The offset temperature of the toner was 210° C., and so no problem arose on margin of fixing. According to the result of the evaluation of the toner as to image, however, white stripes occurred due to blade filming by the parting agent after printing of 3,000 sheets though no problem arose on initial printing. Therefore, the toner was unfit for practical use. The results are shown in Table 5.

TABLE 5

| | Example | | | Comp. Ex. |
|---|---|---|---|---|
| | 16 | 17 | 18 | 6 |
| Particle diameter of core particles (μm) | 6.3 | 6.6 | 6.6 | 6.5 |
| Thickness of shell (μm) | 0.03 | 0.03 | 0.03 | 0.03 |
| Parting Agent (a): | a-1 | a-1 | a-1 | |
| Amount (part) | 15 | 10 | 20 | — |
| Spheroidicity ratio | 1.2 | 1.3 | 1.2 | |
| Length ratio | 0.6 | 0.6 | 0.5 | |
| Endothermic peak (° C.) | 63 | 63 | 63 | |
| Parting Agent: | — | — | — | Paraffin wax |
| Amount (part) | | | | 15 |
| Parting Agent (b): | b-2 | b-2 | b-2 | b-2 |
| Amount (part) | 2 | 2 | 2 | 2 |
| Heating loss (%) | 0.2 | 0.2 | 0.2 | 0.2 |
| Evaluation of toner: | | | | |
| dv (μm) | 6.4 | 6.7 | 6.5 | 6.6 |
| dv/dp | 1.24 | 1.27 | 1.23 | 1.26 |
| Volume resistivity (logΩ · cm) | 11.3 | 11.2 | 11.4 | 11.4 |
| Charge level (μc/g) (23° C., 50% RH) | −34 | −32 | −36 | −36 |
| Fixing temperature (° C.) | 120 | 115 | 125 | 140 |
| Offset temperature (° C.) | 220 | 210 | 210 | 210 |
| Shelf stability (%) | ◎ | ○ | ◎ | Δ |
| Flowability (%) | 62 | 60 | 64 | 42 |
| Dependence of image quality on environment | | | | |
| (H/H) | ○ | ○ | ○ | Δ |
| (L/L) | ○ | ○ | ○ | ○ |
| Durability of image quality | ○ | ○ | ○ | X |

(Note)
(1) a-1: Pentaerythritol tetramyristate
(2) b-2: Low-molecular weight polypropylene wax

Example 19

Polymer particles of core-shell structure and a toner were obtained in the same manner as in Example 13 except that 4 parts of Parting Agent (b-3) prepared in Referential Example 3 were used in place of 2 parts of Parting Agent (b-1) in Example 13. The results are shown in Table 6.

Example 20

Polymer particles of core-shell structure and a toner were obtained in the same manner as in Example 14 except that 1 part of Parting Agent (b-3) prepared in Referential Example 3 was used in place of 2 parts of Gil Parting Agent (b-1) in Example 14. The results are shown in Table 6.

Comparative Example 7

Untreated low-molecular weight polypropylene wax ("Viscol 660P", trade name; product of Sanyo Chemical Industries, Ltd.) was subjected to a grinding treatment in the same manner as in Comparative Example 6. However, only coarse particles having a volume average particle diameter of 10 μm were able to be obtained. Such coarse wax particles were unable to be used upon the formation of core particles by suspension polymerization.

Example 21

Polymer particles of core-shell structure and a toner were obtained in the same manner as in Example 13 except that 5 parts of a yellow pigment ("Toner Yellow HGVP2155", trade name; product of Clariant Co.) were used in place of 7 parts of carbon black in Example 13, and a polar resin (styrene.butyl acrylate.2-acrylamide-2-methylpropanesulfonic acid terpolymer) was used in place of the charge control agent ("Spiron Black TRH", trade name; product of Hodogaya Chemical Co., Ltd.). The results are shown in Table 6. Incidentally, the monomer composition of the polar resin were 87 parts of styrene, 10 parts of butyl acrylate and 3 parts of 2-acrylamide-2-methylpropanesulfonic acid, and its weight average molecular weight was 21,000.

TABLE 6

| | Example | | Comp. Ex. | Ex. |
|---|---|---|---|---|
| | 19 | 20 | 7 | 21 |
| Particle diameter of core particles (μm) | 6.4 | 6.6 | — | 6.5 |
| Thickness of shell (μm) | 0.03 | 0.03 | — | 0.03 |
| Parting Agent (a): | a-1 | a-2 | — | a-1 |
| Amount (part) | 15 | 15 | — | 15 |
| Spheroidicity ratio | 1.3 | 1.2 | — | 1.3 |
| Length ratio | 0.6 | 0.6 | — | 0.6 |
| Endothermic peak (° C.) | 63 | 65 | — | 63 |
| Parting Agent: | — | — | 660P | — |
| Amount (part) | | | 15 | |
| Parting Agent (b): | b-3 | b-3 | — | b-1 |
| Amount (part) | 4 | 1 | — | 2 |
| Heating loss (%) | 0.5 | 0.5 | — | 0.3 |
| Evaluation of toner: | | | | |
| dv (μm) | 6.5 | 6.7 | — | 6.6 |
| dv/dp | 1.24 | 1.26 | — | 1.27 |
| Volume resistivity (logΩ · cm) | 11.3 | 11.3 | — | 11.6 |
| Charge level (μc/g) (23° C., 50% RH) | −34 | −36 | — | −40 |
| Fixing temperature (° C.) | 120 | 125 | — | 120 |
| Offset temperature (° C.) | 190 | 180 | — | 200 |
| Shelf stability (%) | ○ | ◎ | — | ◎ |
| Flowability (%) | 66 | 65 | — | 68 |
| Dependence of image quality on environment | | | | |
| (H/H) | ○ | ○ | — | ○ |
| (L/L) | ○ | ○ | — | ○ |
| Durability of image quality | ○ | ○ | — | ○ |

(Note)
(1) a-1: Pentaerythritol tetramyristate
(2) a-2: Pentaerythritol tetrapalmitate
(3) b-1: Fischer-Tropsch wax derived from natural gas
(4) b-3: Microcrystalline wax
(5) 660P: Low-molecular weight polypropylene wax

Comparative Example 8

Polymer particles of core-shell structure and a toner were obtained in the same manner as in Example 13 except that 12 parts (2 parts of wax) of the emulsion of Fischer-Tropsch wax ("FT-100", trade name; product of Shell MDS Co.) derived from natural gas, which was not dried after the emulsification in Referential Example 1, were used in place of 2 parts of Parting Agent (b-1) in Example 13. The results are shown in Table 7.

Comparative Example 9

Polymer particles of core-shell structure and a toner were obtained in the same manner as in Example 14 except that 12 parts (2 parts of wax) of the emulsion of low-molecular weight polypropylene wax ("Viscol 660P", trade name; product of Sanyo Chemical Industries, Ltd.), which was not dried after the emulsification in Referential Example 2, were used in place of 2 parts of Parting Agent (b-1) in Example 14. The results are shown in Table 7.

Comparative Example 10

Polymer particles of core-shell structure and a toner were obtained in the same manner as in Example 15 except that 12 parts (2 parts of wax) of the emulsion of microcrystalline wax ("Hi-Mic-3090", trade name; product of Nippon Seiro Co., Ltd.), which was not dried after the emulsification in Referential Example 3, were used in place of 2 parts of Parting Agent (b-1) in Example 15. The results are shown in Table 7.

TABLE 7

| | Comparative Example | | |
|---|---|---|---|
| | 8 | 9 | 10 |
| Particle diameter of core particles (μm) | 7.6 | 8.2 | 7.2 |
| Thickness of shell (μm) | 0.04 | 0.04 | 0.04 |
| Parting Agent (a): | a-1 | a-2 | a-3 |
| Amount (part) | 15 | 15 | 15 |
| Spheroidicity ratio | 1.3 | 1.3 | 1.4 |
| Length ratio | 0.6 | 0.6 | 0.7 |
| Endothermic peak (° C.) | 63 | 65 | 53 |
| Parting Agent: | FT-100 | 660P | 3090 |
| Amount (part) | 2 | 2 | 2 |
| Evaluation of toner: | | | |
| dv (μm) | 7.8 | 8.4 | 7.3 |
| dv/dp | 1.48 | 1.53 | 1.36 |
| Volume resistivity (logΩ · cm) | 11.2 | 11.1 | 11.2 |
| Charge level (μc/g) (23° C., 50% RH) | −33 | −31 | −35 |
| Fixing temperature (° C.) | 120 | 125 | 115 |
| Offset temperature (° C.) | 180 | 200 | 170 |
| Shelf stability (%) | Δ | Δ | Δ |
| Flowability (%) | 48 | 42 | 52 |
| Dependence of image quality on environment | | | |
| (H/H) | ○ | ○ | ○ |
| (L/L) | ○ | ○ | ○ |
| Durability of image quality | X | X | X |

(Note)
(1) a-1: Pentaerythritol tetramyristate
(2) a-2: Pentaerythritol tetrapalmitate
(3) a-3: Pentaerythritol tetralaurate
(4) FT-100: Fischer-Tropsch wax derived from natural gas
(5) 660P: Low-molecular weight polypropylene wax
(6) 3090: Microcrystalline wax

INDUSTRIAL APPLICABILITY

According to the present invention, there are provided polymerized toners which have a low fixing temperature and uniformly melting ability, and moreover are excellent in shelf stability, and a production process thereof. According to the present invention, there are also provided polymerized toners which have excellent offset resistance, shelf stability and flowability, can meet the high-speed printing at a low fixing temperature, can achieve high resolution and are suitable for use as color toners, and a production process thereof. The use of the polymerized toners according to the present invention permits the speeding-up of copying or printing, the formation of full-color images and energy saving. The polymerized toners according to the present invention can form toner images which exhibit excellent permeability when conducting printing on an OHP sheet with such a polymerized toner and fixing the resulting image thereto. The polymerized toners according to the present invention permit the formation of high-quality images without causing fogging and deterioration of image density. According to the present invention, there are provided an image forming process comprising using the polymerized toner(s) having such excellent various properties, and an image forming apparatus in which the polymerized toner(s) are received.

What is claimed is:

1. A polymerized toner of core-shell structure, comprising core particles composed of colored polymer particles, which comprise a polyfunctional ester compound formed of a trifunctional or still higher polyfunctional polyhydric alcohol and a carboxylic acid, and a colorant, and shell which is formed of a polymer having a glass transition temperature higher than that of a polymer component making up the core particles and covers each of the core particles.

2. The polymerized toner according to claim 1, wherein the core particles are colored polymer particles obtained by subjecting a polymerizable monomer composition containing a polymerizable monomer for core, the polyfunctional ester compound formed of the polyhydric alcohol and the carboxylic acid, and the colorant to suspension polymerization.

3. The polymerized toner according to claim 1, wherein the core particles are colored polymer particles obtained by subjecting a polymerizable monomer composition containing a polymerizable monomer for core, the polyfunctional ester compound formed of the polyhydric alcohol and the carboxylic acid, and the colorant to suspension polymerization in the presence of a macromonomer.

4. The polymerized toner according to claim 1, wherein the shell is a polymer layer formed on the core particle surface by subjecting a polymerizable monomer for shell to suspension polymerization in the presence of the core particles.

5. The polymerized toner according to claim 1, wherein the polyfunctional ester compound is contained in a proportion of 0.1 to 40 parts by weight per 100 parts by weight of the polymer component making up the core particles.

6. The polymerized toner according to claim 1, wherein the polyfunctional ester compound is a compound represented by the formula (I):

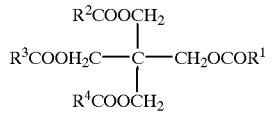

(I)

wherein $R^1$, $R^2$, $R^3$ and $R^4$ are independently an alkyl group or phenyl group, and the number of carbon atoms of the alkyl group or phenyl group is 10 to 30.

7. The polymerized toner according to claim 6, wherein the polyfunctional ester compound is pentaerythritol tetrastearate, pentaerythritol tetramyristate, pentaerythritol tetrapalmitate or pentaerythritol tetralaurate.

8. The polymerized toner according to claim 1, wherein the core particles further comprise, in addition to the polyfunctional ester compound, a parting agent (b) prepared by finely dispersing a hydrophobic material hardly soluble in a polymerizable monomer in water and then drying the resultant dispersion.

9. The polymerized toner according to claim 8, wherein a weight ratio of the parting agent (a) to the parting agent (b) is 99/1 to 50/50.

10. The polymerized toner according to claim 8, wherein a ratio of a spheroidicity of the section of the parting agent (a) to a spheroidicity of the section of the polymerized toner in the polymerized toner is 1.0 to 1.5, and a ratio of the sectional length of the parting agent (a) to the sectional length of the polymerized toner is 0.3 to 0.7.

11. The polymerized toner according to claim 8, wherein the parting agent (b) is prepared by using Fischer-Tropsch wax, low-molecular weight polypropylene wax or microcrystalline wax as a hydrophobic material.

12. A process for producing a polymerized toner of core-shell structure, which comprises the steps of (1) subjecting a polymerizable monomer composition containing a polyfunctional ester compound formed of a trifunctional or still higher polyfunctional polyhydric alcohol and a carboxylic acid, a colorant, and a polymerizable monomer for core, which is capable of forming a polymer having a glass transition temperature of 80° C. or lower, to suspension polymerization in an aqueous dispersion medium containing a dispersing agent to prepare core particles formed of colored polymer particles; and then (2) subjecting a polymerizable monomer for shell, which is capable of forming a polymer having a glass transition temperature higher than that of a polymer component making up the core particles, to suspension polymerization in the presence of the core particles, thereby forming shell which is formed of a polymer layer and covers each of the core particles.

13. The production process according to claim 12, wherein in the step (1), the polymerizable monomer composition is subjected to the suspension polymerization in the presence of a macromonomer to prepare core particles formed of colored polymer particles.

14. The production process according to claim 12, wherein the polyfunctional ester compound is contained in a proportion of 0.1 to 40 parts by weight per 100 parts by weight of the polymerizable monomer for core.

15. The production process according to claim 12, wherein the polyfunctional ester compound is a compound represented by the formula (I):

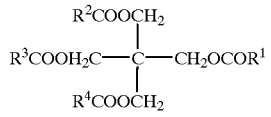

(I)

wherein $R^1$, $R^2$, $R^3$ and $R^4$ are independently an alkyl group or phenyl group, and the number of carbon atoms of the alkyl group or phenyl group is 10 to 30.

16. The production process according to claim 15, wherein the polyfunctional ester compound is pentaerythritol tetrastearate, pentaerythritol tetramyristate, pentaerythritol tetrapalmitate or pentaerythritol tetralaurate.

17. The production process according to claim 12, wherein in the step (1), a parting agent (b) prepared by finely dispersing a hydrophobic material hardly soluble in the polymerizable monomer in water and then drying the resultant dispersion is further contained in addition to the polyfunctional ester compound in the polymerizable monomer composition.

18. The production process according to claim 12 or 17, wherein in the steps (1) and (2), the polymerization is conducted at a temperature not higher than the endothermic peak temperature of the polyfunctional ester compound.

19. The production process according to claim 12, wherein in the step (2), shell formed of a polymer layer having an average film thickness of 0.001 to 1 $\mu$m is formed.

* * * * *